US010020562B2

(12) United States Patent
Lee et al.

(10) Patent No.: US 10,020,562 B2
(45) Date of Patent: Jul. 10, 2018

(54) ANTENNA STRUCTURE AND WIRELESS COMMUNICATION DEVICE USING SAME

(71) Applicant: Chiun Mai Communication Systems, Inc., New Taipei (TW)

(72) Inventors: Cheng-Han Lee, New Taipei (TW); Yi-Wen Hsu, New Taipei (TW); Wei-Xuan Ye, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/651,035

(22) Filed: Jul. 17, 2017

(65) Prior Publication Data

US 2018/0026349 A1 Jan. 25, 2018

Related U.S. Application Data

(60) Provisional application No. 62/364,298, filed on Jul. 19, 2016.

(30) Foreign Application Priority Data

Jun. 27, 2017 (TW) ..... 106121492 A

(51) Int. Cl.

| | |
|---|---|
| ***H04M 1/00*** | (2006.01) |
| ***H01Q 1/24*** | (2006.01) |
| ***H01Q 5/371*** | (2015.01) |
| ***H01Q 5/10*** | (2015.01) |
| ***H01Q 13/10*** | (2006.01) |

(52) U.S. Cl.

CPC ..... *H01Q 1/243* (2013.01); *H01Q 5/10* (2015.01); *H01Q 5/371* (2015.01); *H01Q 13/10* (2013.01)

(58) Field of Classification Search

CPC ..... H01Q 1/243; H04Q 1/245
USPC ..... 455/575.7
See application file for complete search history.

(56) References Cited

U.S. PATENT DOCUMENTS

| | | | | |
|---|---|---|---|---|
| 7,876,274 | B2 * | 1/2011 | Hobson | H01Q 1/243 343/702 |
| 8,233,950 | B2 * | 7/2012 | Hobson | H01Q 1/243 343/714 |
| 8,270,914 | B2 * | 9/2012 | Pascolini | H01Q 1/243 343/702 |
| 8,472,203 | B2 * | 6/2013 | Dabov | H01Q 1/243 361/753 |
| 8,532,697 | B2 * | 9/2013 | Pascolini | H03H 7/38 343/711 |

(Continued)

FOREIGN PATENT DOCUMENTS

| | | |
|---|---|---|
| WO | 2015/015052 A1 | 2/2015 |
| WO | 2016/015284 A1 | 2/2016 |

*Primary Examiner* — April G Gonzales
(74) *Attorney, Agent, or Firm* — ScienBiziP, P.C.

(57) ABSTRACT

An antenna structure includes a metal housing, a first feed source, and a first switching circuit. The metal housing includes a front frame, a backboard, and a side frame. The side frame defines a slot and the front frame defines a first gap and a second gap. The metal housing is divided into at least a first branch and a second branch by the slot, the first gap, and the second gap. The first feed source is electrically connected to the first branch. One end of the first switching circuit is electrically connected to the first branch. Another end of the first switching circuit is grounded.

26 Claims, 36 Drawing Sheets

(56) References Cited

U.S. PATENT DOCUMENTS 8,750,949 B2 * 6/2014 Merz ..... H04B 1/38 343/702
8,781,420 B2 * 7/2014 Schlub ..... H01Q 1/243 455/115.1
9,071,336 B2 * 6/2015 Schlub ..... H01Q 1/243
9,179,299 B2 * 11/2015 Schlub ..... H01Q 1/243
2001/0053672 A1 * 12/2001 Masaki ..... H01Q 1/22 455/575.7
2007/0060222 A1 * 3/2007 Finn ..... H01Q 1/2266 455/575.7
2009/0131129 A1 * 5/2009 Yamazaki ..... H01Q 1/084 455/575.7
2011/0250928 A1 * 10/2011 Schlub ..... H01Q 1/243 455/550.1
2012/0009983 A1 * 1/2012 Mow ..... H01Q 1/243 455/575.7
2012/0115553 A1 * 5/2012 Mahe ..... H04B 7/0825 455/575.7
2012/0299785 A1 * 11/2012 Bevelacqua ..... H01Q 9/42 343/702
2014/0206297 A1 * 7/2014 Schlub ..... H01Q 1/243 455/77
2014/0243052 A1 * 8/2014 Hobson ..... H01Q 1/243 455/575.7
2014/0323063 A1 * 10/2014 Xu ..... H01Q 1/243 455/77
2014/0347227 A1 * 11/2014 Iellici ..... H01Q 1/243 343/702
2015/0005037 A1 * 1/2015 Caballero ..... H01Q 1/243 455/566
2015/0188230 A1 * 7/2015 Kim ..... H01Q 9/0421 455/90.2
2015/0249485 A1 * 9/2015 Ouyang ..... H04B 5/0081 455/41.1
2015/0249916 A1 * 9/2015 Schlub ..... H01Q 1/243 455/419
2015/0255857 A1 * 9/2015 Kim ..... H01Q 1/243 343/702
2016/0064820 A1 * 3/2016 Kim ..... H01Q 1/243 343/767

* cited by examiner

ANTENNA STRUCTURE AND WIRELESS COMMUNICATION DEVICE USING SAME

CROSS-REFERENCE TO RELATED APPLICATIONS

This application claims priority to Taiwanese Patent Application No. 106121492 filed on Jun. 27, 2017, claims priority to U.S. Patent Application No. 62/364,298 filed on Jul. 19, 2016, and the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect an integrity and an aesthetic quality of the metallic backboard.

BRIEF DESCRIPTION OF THE DRAWINGS

Implementations of the present technology will now be described, by way of example only, with reference to the attached figures.

DETAILED DESCRIPTION

Figure 1:
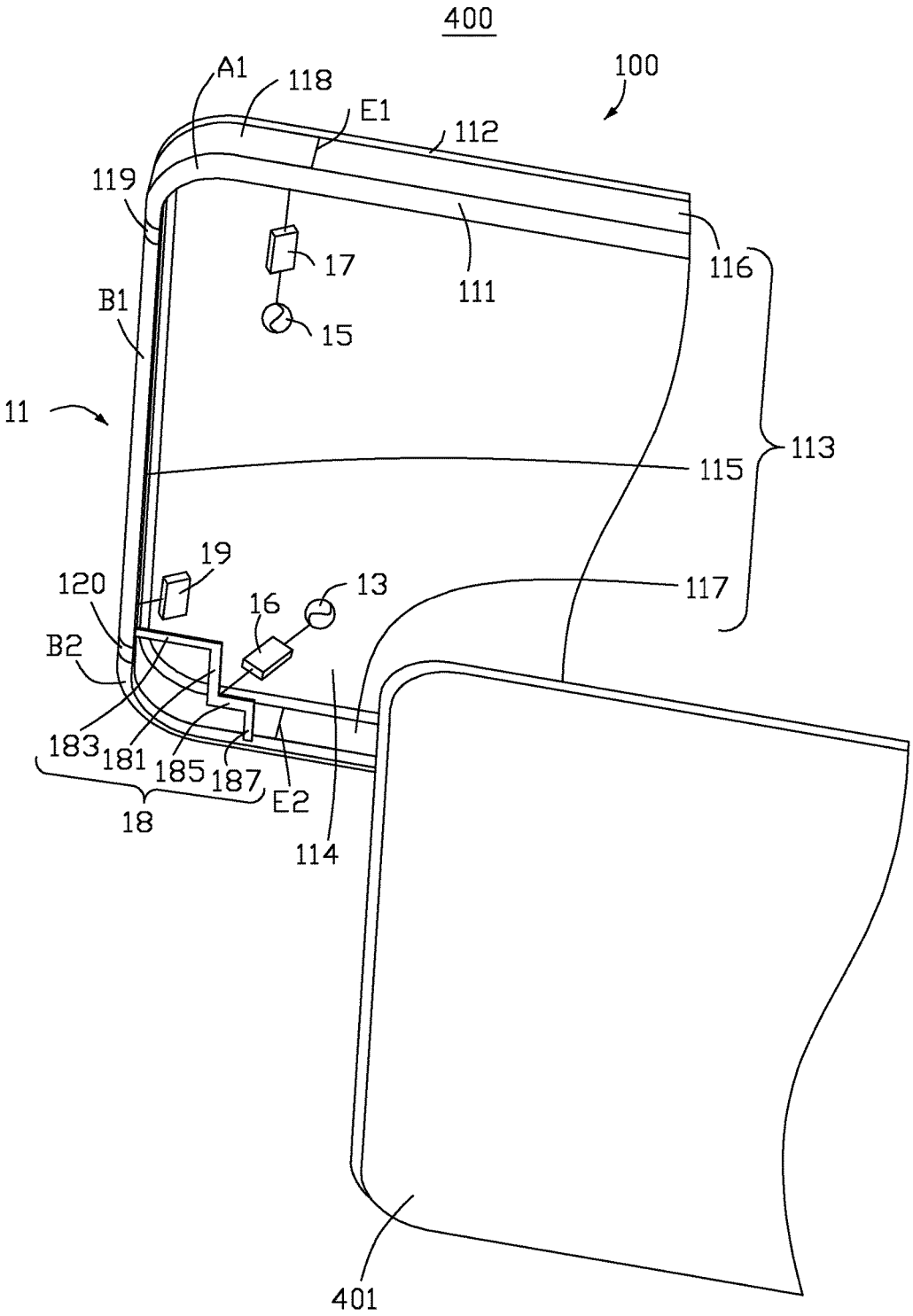
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

Exemplary Embodiment 1

FIG. 1 illustrates an embodiment of a wireless communication device 400 using a first exemplary antenna structure 100. The wireless communication device 400 can be a mobile phone or a personal digital assistant, for example. The antenna structure 100 can receive and/or transmit wireless signals.

Figure 2:
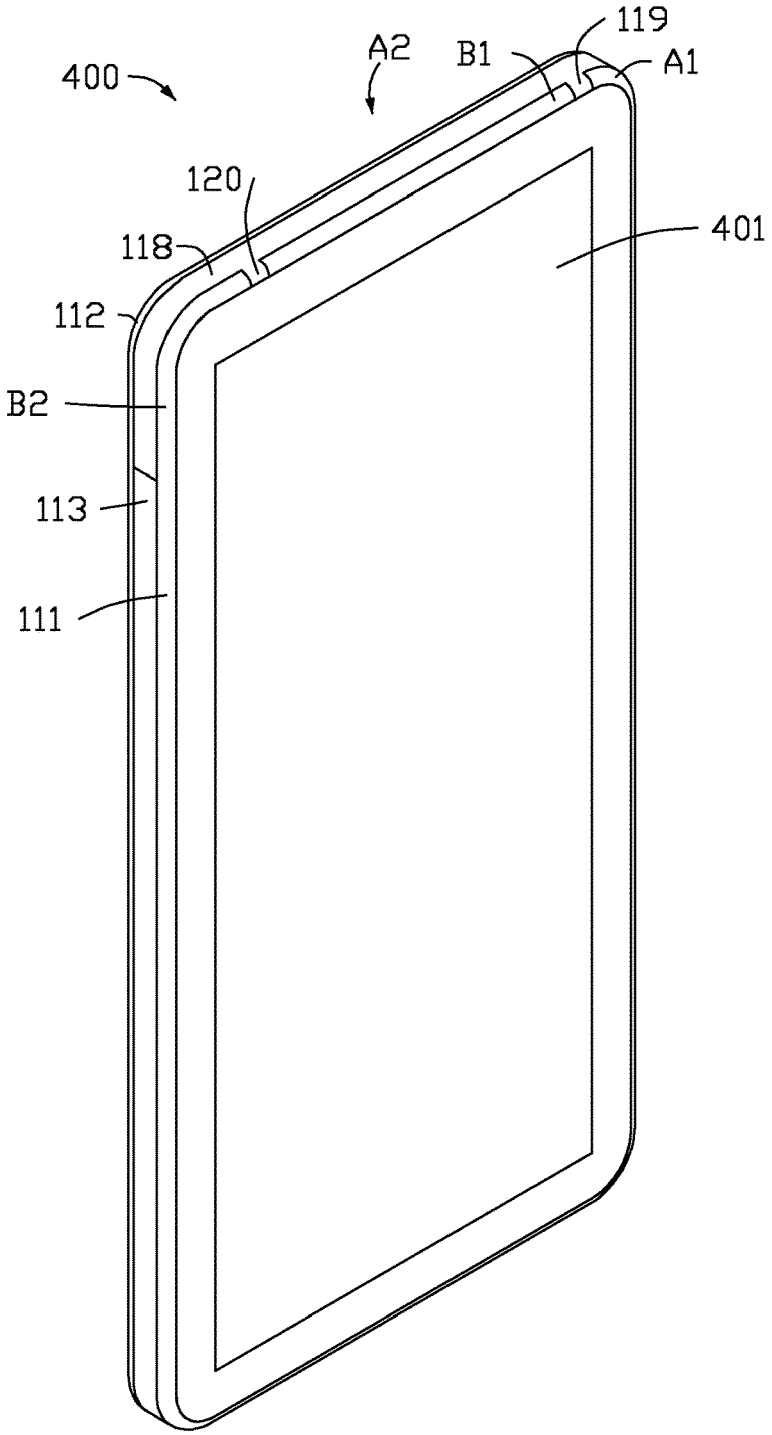
FIG. 2 is an assembled, isometric view of the wireless communication device of FIG. 1.
Figure 3:
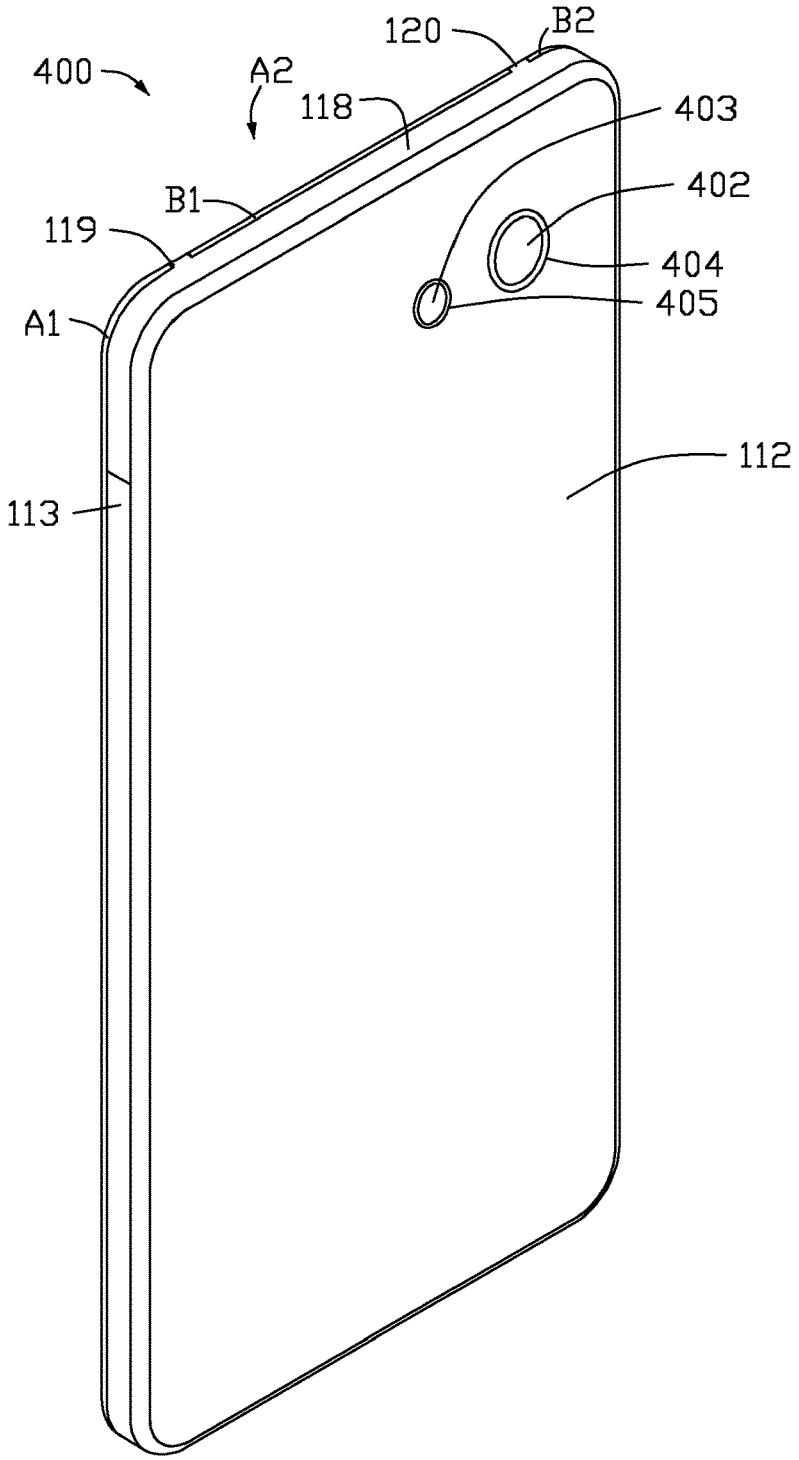
FIG. 3 is a circuit diagram of the antenna structure of FIG. 1.

Per FIG. 2 and FIG. 3, the antenna structure 100 includes a housing 11, a first feed source 13, a second feed source 15, a first matching circuit 16, a second matching circuit 17, a connecting portion 18, and a switching circuit 19. The housing 11 can be a metal housing of the wireless communication device 400. In this exemplary embodiment, the housing 11 is made of metallic material. The housing 11 includes a front frame 111, a backboard 112, and a side frame 113. The front frame 111, the backboard 112, and the side frame 113 can be integral with each other. The front frame 111, the backboard 112, and the side frame 113 cooperatively form the housing of the wireless communication device 400.

The front frame 111 defines an opening (not shown). The wireless communication device 400 includes a display 401. The display 401 is received in the opening. The display 401 has a display surface. The display surface is exposed at the opening and is positioned parallel to the backboard 112.

Figure 4:
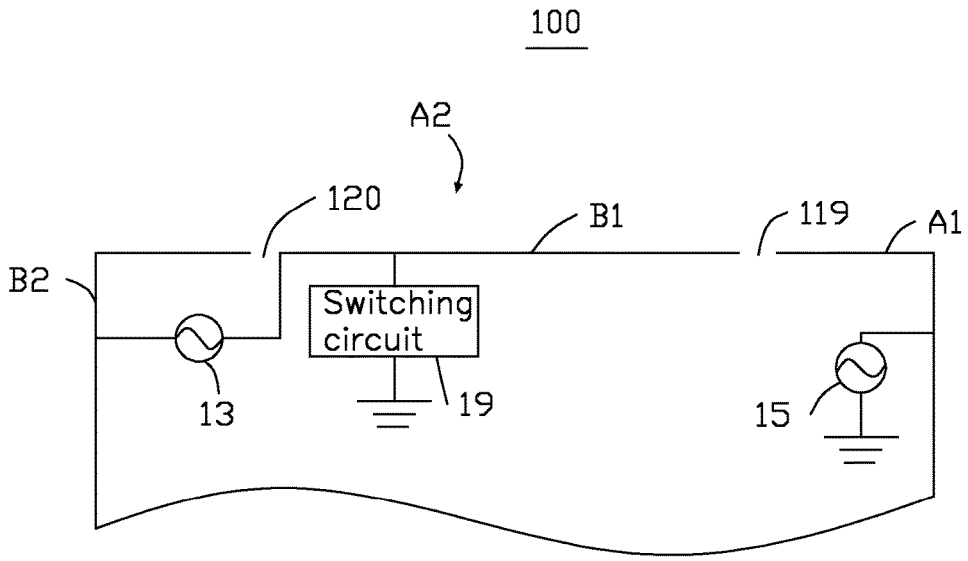
FIG. 4 is similar to FIG. 2, but shown from another angle.

Per FIG. 4, the backboard 112 is positioned opposite to the front frame 111. The backboard 112 is directly connected to the side frame 113 and there is no gap between the backboard 112 and the side frame 113. The backboard 112 is an integral and single metallic sheet. Except for the holes 404 and 405 exposing a camera lens 402 and a flash light 403, the backboard 112 does not define any other slot, break line, and/or gap. The backboard 112 serves as the ground of the antenna structure 100.

The side frame 113 is positioned between the backboard 112 and the front frame 111. The side frame 113 is positioned around a periphery of the backboard 112 and a periphery of the front frame 111. The side frame 113 forms a receiving space 114 together with the display 401, the front frame 111, and the backboard 112. The receiving space 114 can receive a printed circuit board, a processing unit, or other electronic components or modules.

The side frame 113 includes an end portion 115, a first side portion 116, and a second side portion 117. In this exemplary embodiment, the end portion 115 can be a top portion of the wireless communication device 400. The end portion 115 connects the front frame 111 and the backboard 112. The first side portion 116 is positioned apart from and parallel to the second side portion 117. The end portion 115 has first and second ends. The first side portion 116 is connected to the first end of the first frame 111 and the second side portion 117 is connected to the second end of the end portion 115. The first side portion 116 and the second side portion 117 both connect to the front frame 111.

The side frame 113 defines a slot 118. The front frame 111 defines a gap 119 and a groove 120. In this exemplary embodiment, the slot 118 is defined at the end portion 115 and extends to the first side portion 116 and the second side portion 117. In other exemplary embodiments, the slot 118 is defined only at the end portion 115 and does not extend to any one of the first side portion 116 and the second side portion 117. In other exemplary embodiments, the slot 118 can be defined at the end portion 115 and extend to one of the first side portion 116 and the second side portion 117.

The gap 119 communicates with the slot 118 and extends to cut across the front frame 111. In this exemplary embodiment, the gap 119 is positioned adjacent to the first side portion 116. Then, a portion of the front frame 111 corresponding to the slot 118 is divided into two portions by the gap 119. The two portions are a first radiating portion A1 and a second radiating portion A2. A first portion of the front frame 111 extending from a first side of the gap 119 to a first end E1 of the slot 118 forms the first radiating portion A1. A second portion of the front frame 111 extending from a second side of the gap 119 to a second end E2 of the slot 118 forms the second radiating portion A2. In this exemplary embodiment, the gap 119 is not positioned at a middle portion of the end portion 115. The first radiating portion A1 is longer than the second radiating portion A2.

The groove 120 communicates with the slot 118 and extends to cut across the front frame 111. In this exemplary embodiment, the groove 120 is positioned adjacent to the second side portion 117. Then, the second radiating portion A2 is further divided into two portions by the groove 120. The two portions are a first branch B1 and a second branch B2. A first portion of the front frame 111 between the gap 119 and the groove 120 forms the first branch B1. A second portion of the front frame 111 extending from the side of the groove 120 away from the gap 119 to the second end E2 of the slot 118 forms the second branch B2. In this exemplary embodiment, the groove 120 is not positioned at a middle portion of the second radiating portion A2. The first branch B1 is longer than the second branch B2. The first radiating portion A1 is shorter than the second branch B2.

In this exemplary embodiment, the slot 118, the gap 119, and the groove 120 are all filled with insulating material, for example, plastic, rubber, glass, wood, ceramic, or the like, thereby isolating the first radiating portion A1, the first branch B1 and the second branch B2 of the second radiating portion A2, and the other parts of the housing 11.

In this exemplary embodiment, the slot 118 is defined on the end of the side frame 113 adjacent to the backboard 112 and extends to the front frame 111. Then the first radiating portion A1, the first branch B1 and the second branch B2 of the second radiating portion A2 are fully formed by a portion of the front frame 111. In other exemplary embodiments, a position of the slot 118 can be adjusted. For example, the slot 118 can be defined on the end of the side frame 113 adjacent to the backboard 112 and extends towards the front frame 111. Then the first radiating portion A1, the first branch B1 and the second branch B2 of the second radiating portion A2 are formed by a portion of the front frame 111 and a portion of the side frame 113.

In this exemplary embodiment, except for the slot 118, the gap 119, and the groove 120, a lower half portion of the front frame 111 and the side frame 113 does not define any other slot, break line, and/or gap. That is, there is only a gap 119 and a groove 120 defined on the lower half portion of the front frame 111.

The first feed source 13 is positioned in the receiving space 114 adjacent to the second end E2 of the slot 118. The first feed source 13 is electrically connected to the first branch B1 and the second branch B2 through the first matching circuit 16 and the connecting portion 18. The first feed source 13 supplies current to the first branch B1 which activates a first operation mode to generate radiation signals in a first frequency band. The first feed source 13 also supplies current to the second branch B2 which activates a second operation mode to generate radiation signals in a second frequency band. In this exemplary embodiment, the first operation mode is a low frequency operation mode. The first frequency band is a frequency band of about LTE-A 704-960 MHz. The second operation mode is a middle frequency operation mode. The second frequency band is a frequency band of about LTE-A 1805-2170 MHz.

In this exemplary embodiment, the connecting portion 18 includes a first connecting section 181, a second connecting section 183, a third connecting section 185, and a fourth connecting section 187. The first connecting section 181, the second connecting section 183, the third connecting section 185, and the fourth connecting section 187 are coplanar with each other. The first connecting section 181 is substantially rectangular. One end of the first connecting section 181 is electrically connected to the first feed source 13 through the first matching circuit 16. Another end of the first connecting section 181 extends along a direction parallel to the end portion 115 towards the first side portion 116.

The second connecting section 183 is substantially rectangular. One end of the second connecting section 183 is perpendicularly connected to the end of the first connecting section 181 away from the first feed source 13. Another end of the second connecting section 183 extends along a direction parallel to the first side portion 116 towards the end portion 115. The extension continues until the second connecting section 183 connects to the portion of the first branch B1 adjacent to the groove 120 to feed current to the first branch B1.

The third connecting section 185 is substantially rectangular. One end of the third connecting section 185 is connected to a junction of the first connecting section 185 and the first feed source 13. Another end of the third connecting section 185 extends along a direction parallel to the second connecting section 183 away from the end portion 115. The fourth connecting section 187 is substantially rectangular. One end of the fourth connecting section 187 is perpendicularly connected to the end of the third connecting section 185 away from the first feed source 13. Another end of the fourth connecting section 187 extends along a direction parallel to the first connecting section 181 towards the second side portion 117. The extension continues until the fourth connecting section 187 connects to the portion of the second branch B2 adjacent to the second end E2 to feed current to the second branch B2.

In this exemplary embodiment, the second feed source 15 is positioned in the receiving space 114 adjacent to the first end E1 of the slot 118. One end of the second feed source 15 is electrically connected to the first radiating portion A1 through the second matching circuit 17. Another end of the second feed source 15 is electrically connected to the backboard 112 to supply current to the first radiating portion A1, then the first radiating portion A1 activates a third operation mode to generate radiation signals in a third frequency band. In this exemplary embodiment, the third operation mode is a high frequency operation mode. The frequency bands of the high frequency operation mode include LTE-A 2300-2400 MHz, 2496-2690 MHz, and WIFI 2.4 GHz.

Figure 5:
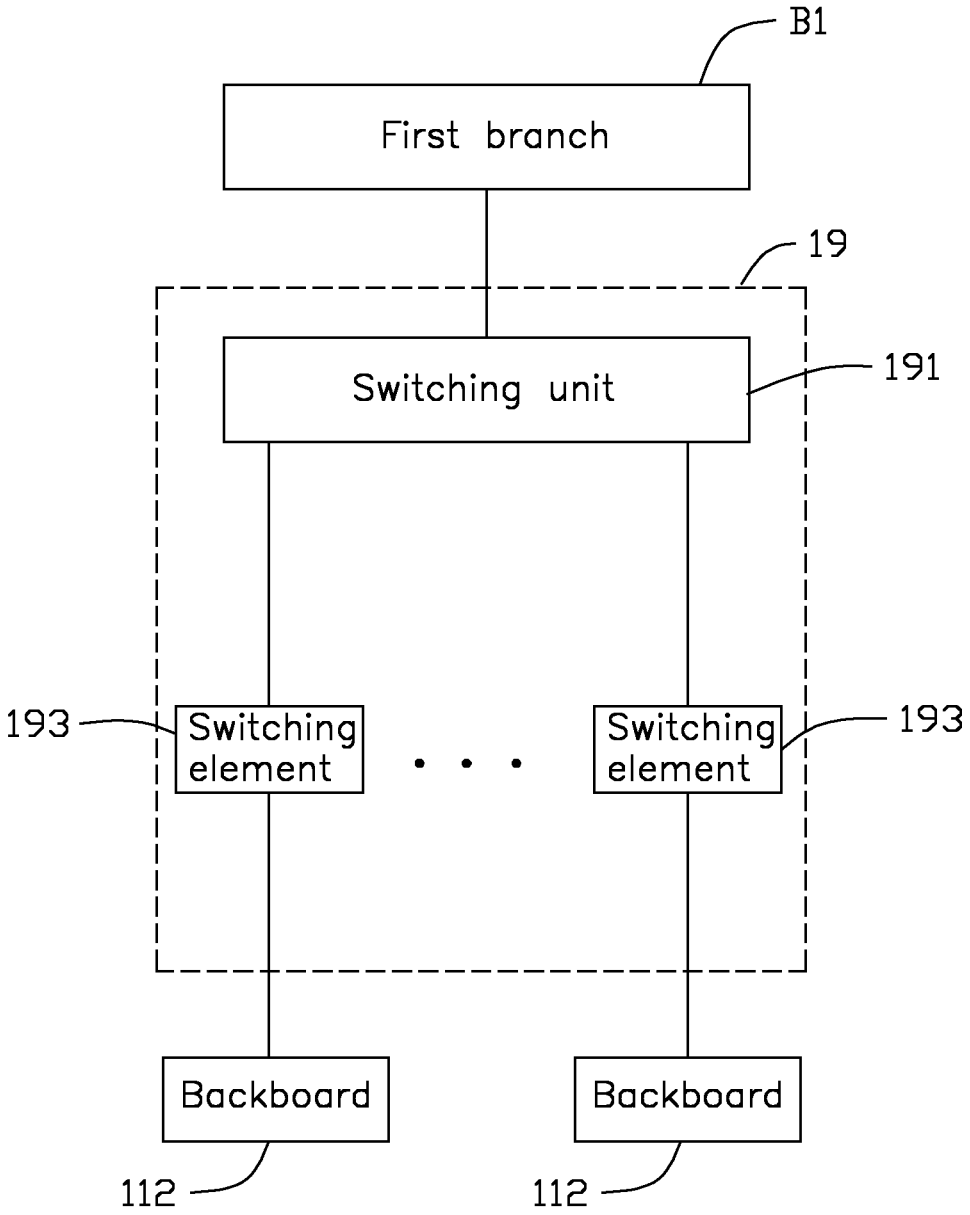
FIG. 5 is a circuit diagram of a switching circuit of the antenna structure of FIG. 1.

Per FIG. 5, one end of the switching circuit 19 is electrically connected to the first branch B1 adjacent to the second connecting section 183. Another end of the switching circuit 19 is electrically connected to the backboard 112 to be grounded. The switching circuit 19 includes a switching unit 191 and a plurality of switching elements 193. The switching unit 191 is electrically connected to the first branch B1. The switching elements 193 can be an inductor, a capacitor, or a combination of the inductor and the capacitor. The switching elements 193 are connected in parallel to each other. One end of each switching element 193 is electrically connected to the switching unit 191. The other end of each switching element 193 is electrically grounded to the ground backboard 112.

Through control of the switching unit 1 backboard 1121, the first branch B1 can be switched to connect with different switching elements 193. Since each switching element 193 has a different impedance, a frequency band of the first operation mode of the first branch B1 can be adjusted.

Figure 6:
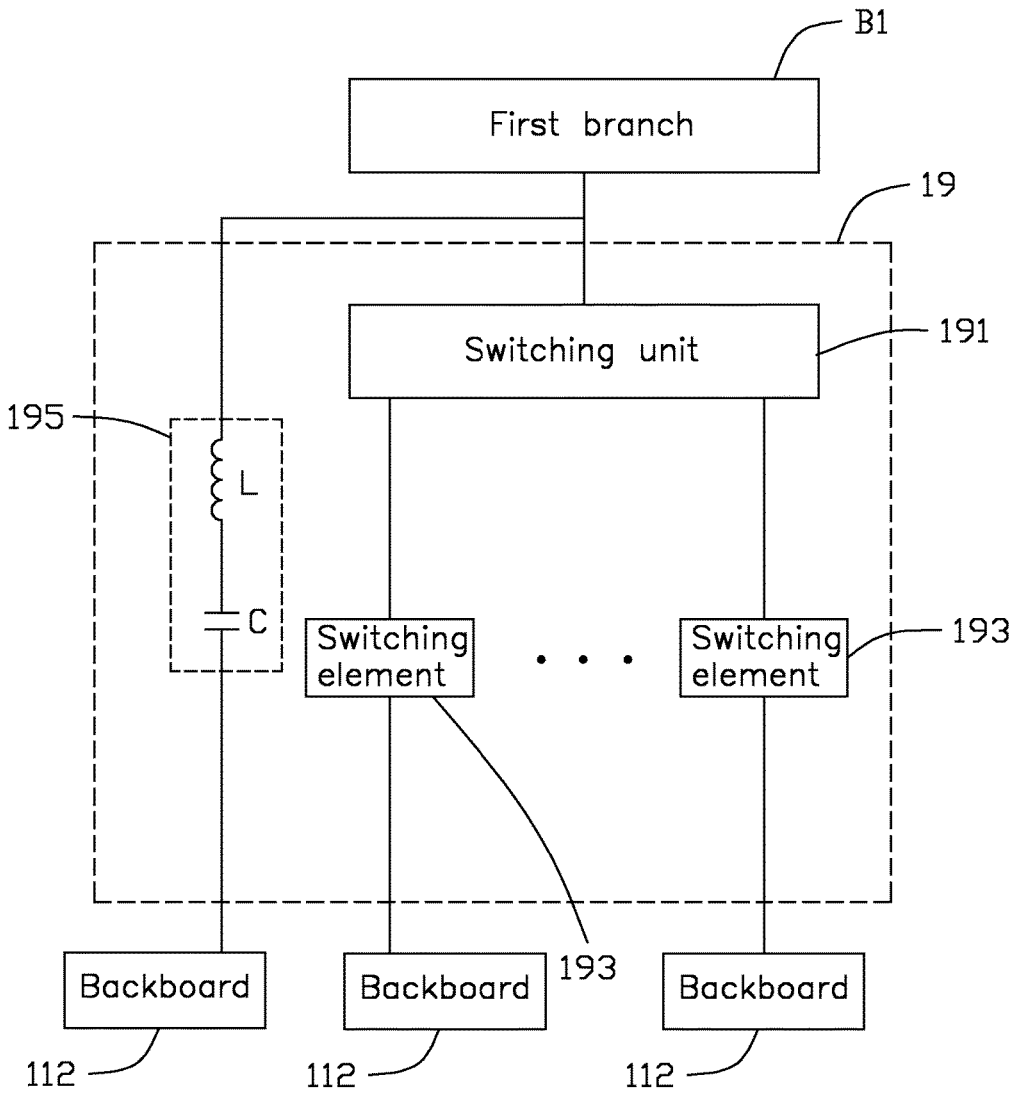
FIG. 6 is a circuit diagram of the switching circuit of FIG. 5, showing the switching circuit includes a resonance circuit.

In this exemplary embodiment, the first branch B1 can further activate a fourth operation mode to generate radiation signals in a fourth frequency band. Per FIG. 6 and FIG. 7, the switching circuit 19 further includes a resonance circuit 195. Per FIG. 6, in one exemplary embodiment, the switching circuit 19 includes one resonance circuit 195. The resonance circuit 195 includes an inductor L and a capacitor C connected in series. The resonance circuit 195 is electrically connected between the first branch B1 and the backboard 112. The resonance circuit 195 is connected in parallel to the switching unit 191 and at least one switching element 193.

Figure 7:
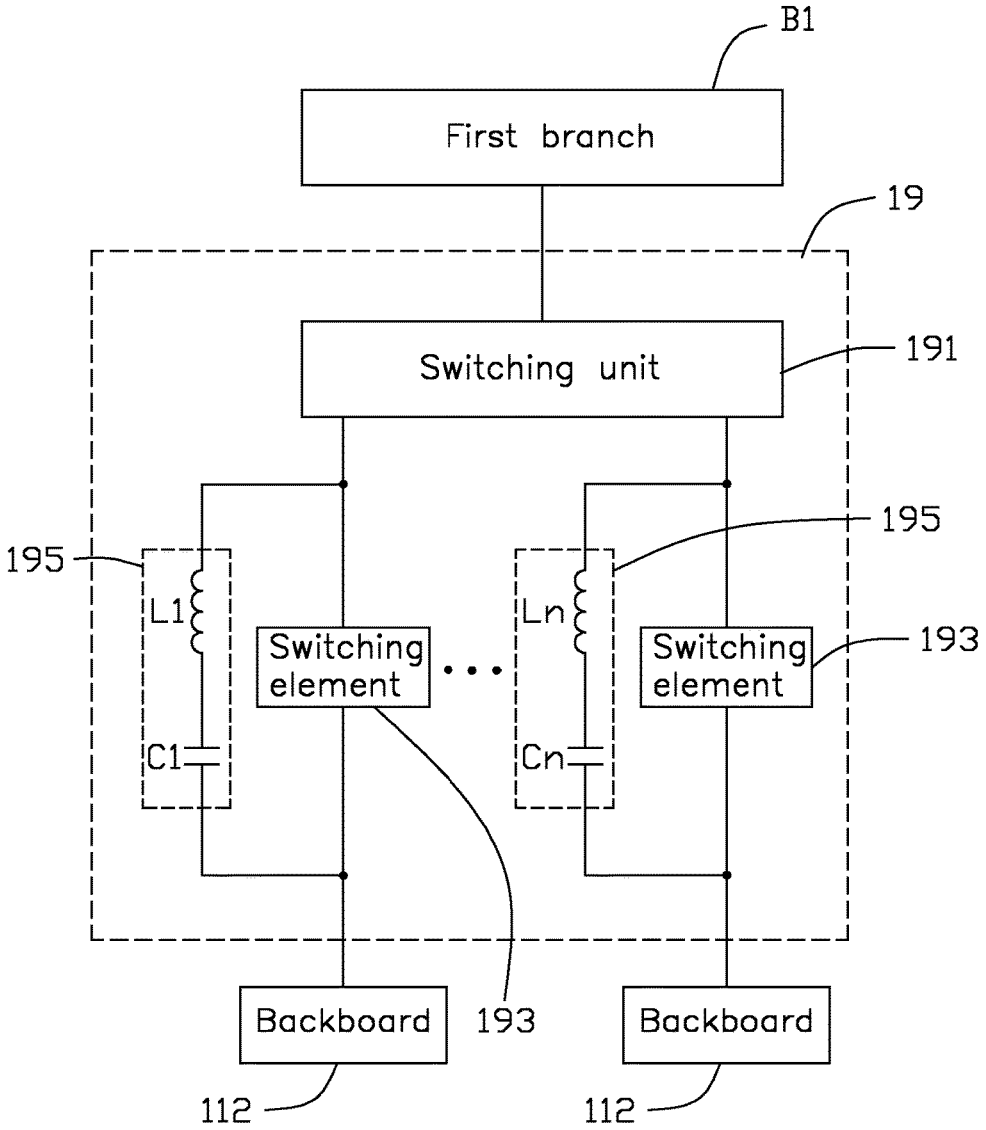
FIG. 7 is similar to FIG. 5, but shown the switching circuit includes another resonance circuit.

Per FIG. 7, in another exemplary embodiment, the switching circuit 19 includes a plurality of resonance circuits 195. The number of the resonance circuits 195 is equal to the number of switching elements 193. Each resonance circuit 195 includes inductors L1-Ln and capacitors C1-Cn connected in series. Each resonance circuit 195 is electrically connected in parallel to one of the switching elements 193 between the switching unit 191 and the backboard 112.

In this exemplary embodiment, the backboard 112 serves as the ground of the antenna structure 100 and the wireless communication device 400. In other exemplary embodiments, the wireless communication device 400 further includes a shielding mask or a middle frame (not shown). The shielding mask is positioned at the surface of the display towards the backboard 112 and shields against electromagnetic interference. The middle frame is positioned at the surface of the display towards the backboard 112 and supports the display. The shielding mask or the middle frame is made of metallic material. The shielding mask or the middle frame can be electrically connected to the backboard 112 to serve as the ground of the antenna structure 100 and wireless communication device 400. Per FIGS. 5-7, the backboard 112 can be replaced by the shielding mask or the middle frame to ground the switching circuit 19.

Figure 8:
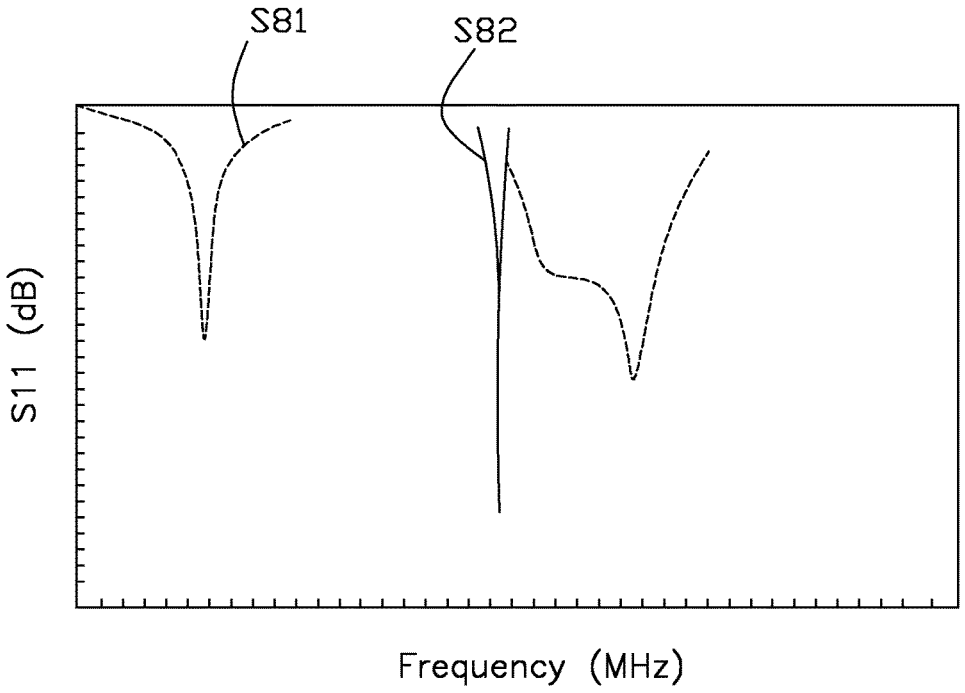
FIG. 8 is a schematic diagram of the antenna structure of FIG. 1, showing the switching circuit of FIG. 6 includes a resonance circuit and generates a resonance mode.

Per FIG. 8, when the switching circuit 19 does not include the resonance circuit 195, the first branch B1 of the antenna structure 100 works at the first operation mode (please see the curve S81). When the switching circuit 19 includes the resonance circuit 195, the first branch B1 of the antenna structure 100 can activate an additional resonance mode (that is, the fourth operation mode, please see the curve S82) to generate radiation signals in the fourth frequency band. The fourth operation mode can effectively broaden an applied frequency band of the antenna structure 100. In one exemplary embodiment, the fourth frequency band is a GPS operation band and the fourth operation mode is the GPS resonance mode.

Figure 9:
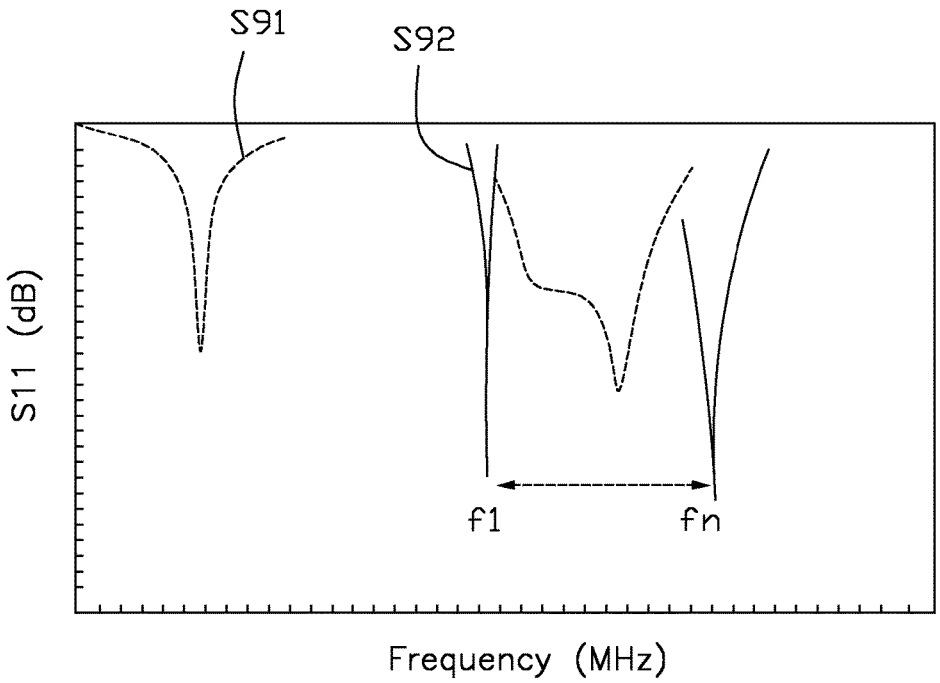
FIG. 9 is a schematic diagram of the antenna structure of FIG. 1, showing the switching circuit of FIG. 7 includes a resonance circuit and generates a resonance mode.

Per FIG. 9, when the switching circuit 19 does not include the resonance circuit 195, the antenna structure 100 works at the first operation mode (please see the curve S91). When the switching circuit 19 includes the resonance circuit 195, the first branch B1 of the antenna structure 100 can activate the additional resonance mode (please see the curve S92), that is, the GPS resonance mode. The resonance mode can effectively broaden an applied frequency band of the antenna structure 100. In one exemplary embodiment, an inductance value of the inductors L1-Ln and a capacitance value of the capacitors C1-Cn of the resonance circuit 195 can cooperatively decide a frequency band of the resonance mode when the first operation mode switches. For example, in one exemplary embodiment, as illustrated in FIG. 9, when the switching unit 191 switches to different switching elements 193 through setting the inductance value and the capacitance value of the resonance circuit 195, the resonance mode of the antenna structure 100 can also be switched. For example, the resonance mode of the antenna structure 100 can be moved from f1 to fn.

In other exemplary embodiments, the frequency band of the resonance mode can be fixed through setting the inductance value and the capacitance value of the resonance circuit 195. Then no matter to which switching element 193 the switching unit 191 is switched, the frequency band of the resonance mode is fixed and keeps unchanged.

Figure 10:
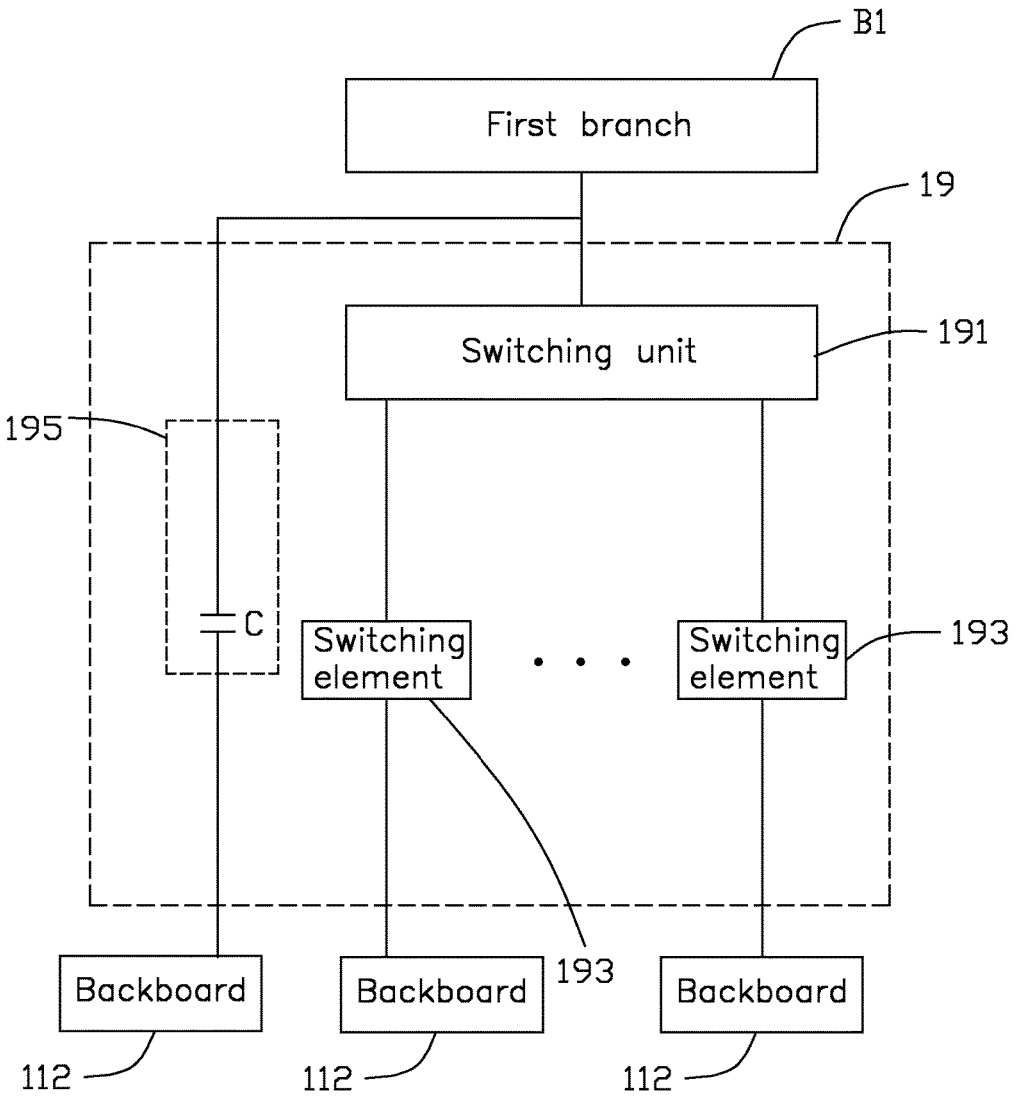
FIG. 10 is similar to FIG. 6, but shown the switching circuit includes another resonance circuit.
Figure 11:
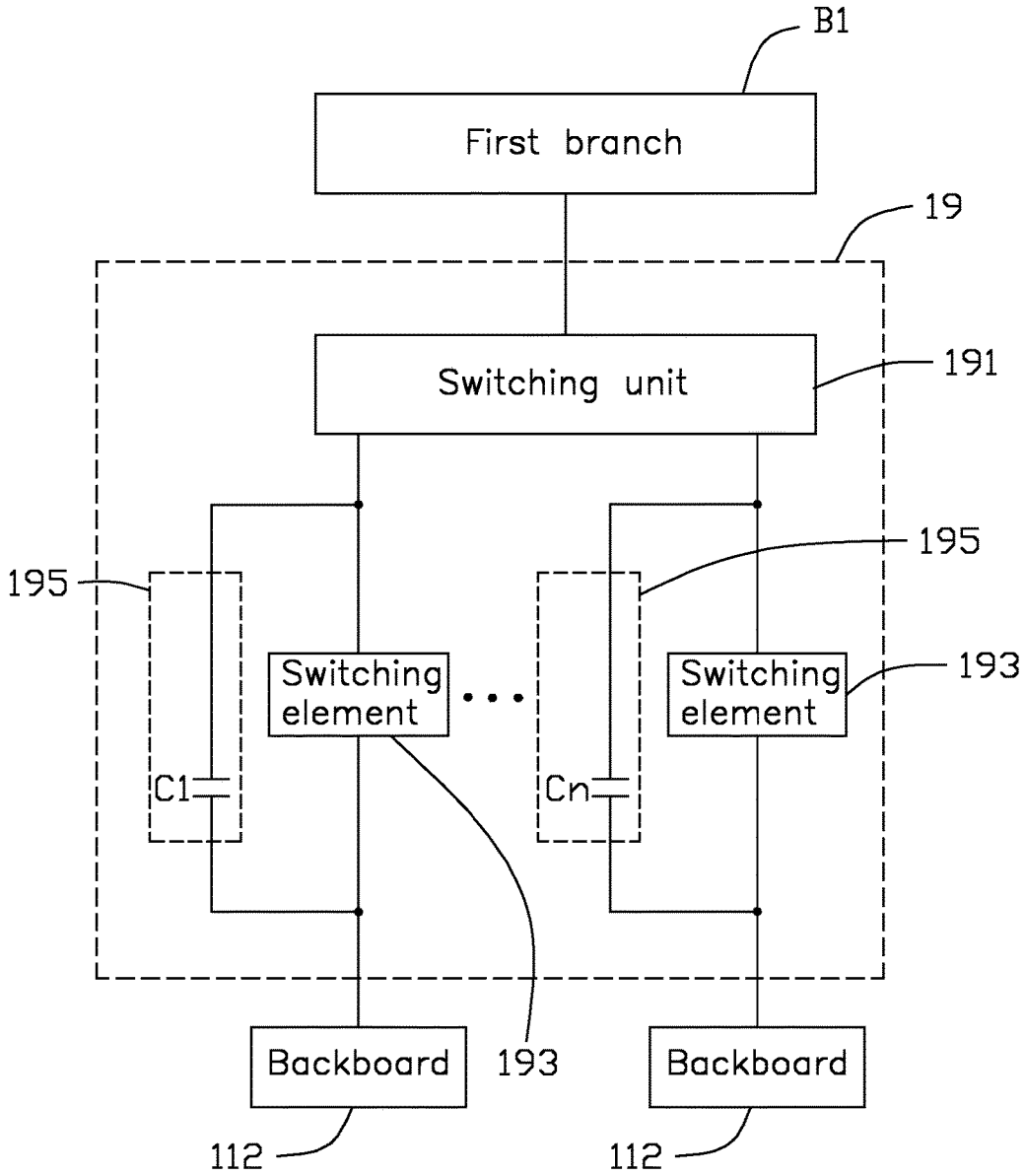
FIG. 11 is similar to FIG. 7, but shown the switching circuit includes another resonance circuit.
Figure 12:
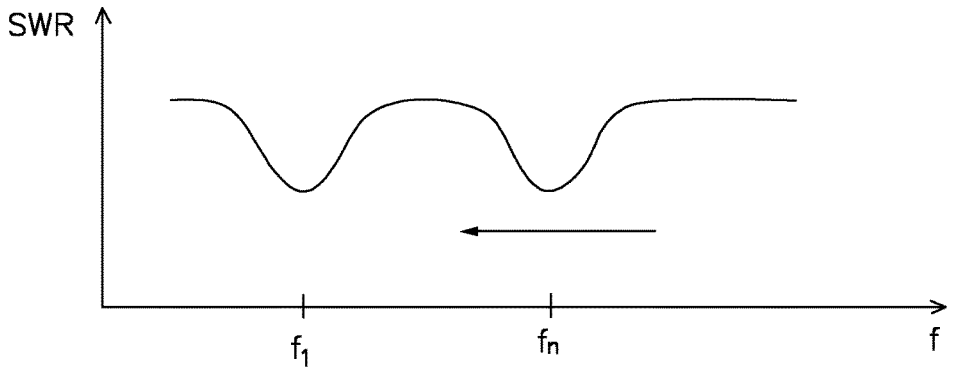
FIG. 12 is a schematic diagram of the antenna structure of FIG. 1, showing the switching circuit of FIGS. 10-11 include a resonance circuit and generates a resonance mode.

In other exemplary embodiments, the resonance circuit 195 is not limited to include the inductors L1-Ln and the capacitors C1-Cn, and can include other resonance components. For example, per FIG. 10 and FIG. 11, in other exemplary embodiments, the resonance circuit 195 includes only one capacitor C or capacitors C1-Cn. Then, per FIG. 12, when the capacitance value of the capacitor C or capacitors C1-Cn is changed, a double frequency mode fh of the resonance mode f1 can also be moved effectively.

Figure 13:
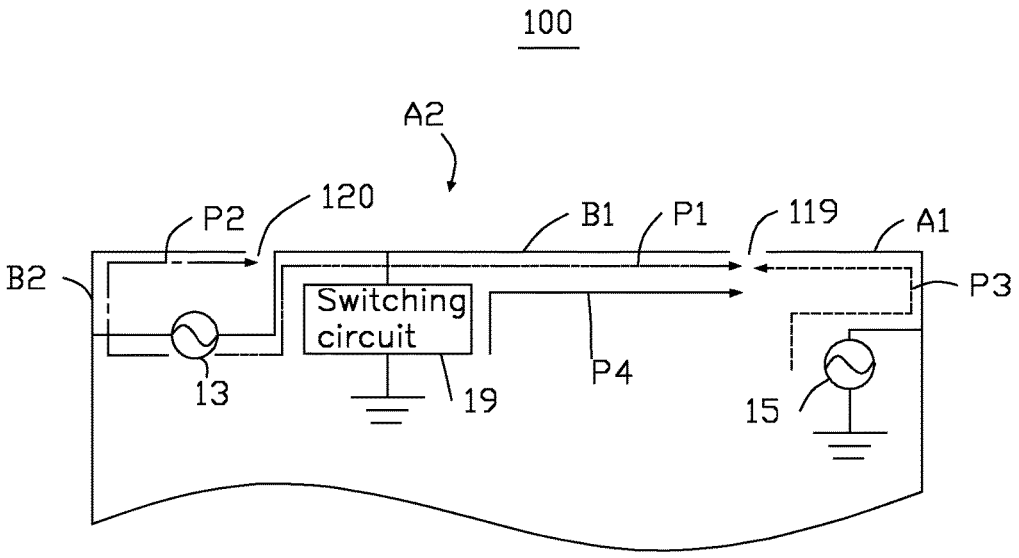
FIG. 13 is a current path distribution graph of the antenna structure of FIG. 1.

Per FIG. 13, when the first feed source 13 supplies current, one portion of the current flows through the first branch B1 of the second radiating portion A2 through the connecting portion 18. Such one portion flows to the gap 119 (e.g., path P1) to activate the first operation mode to generate radiation signals in the first frequency band. When the first feed source 13 supplies current, another portion of the current flows through the second branch B2 of the second radiating portion A2 through the connecting portion 18. Such another portion flows to the groove 120 (e.g., path P2) to activate the second operation mode to generate radiation signals in the second frequency band. When the second feed source 15 supplies current, the current flows through the first radiating portion Al and flows to the gap 119 (e.g., path P3) to activate the third operation mode to generate radiation signals in the third frequency band.

Since the antenna structure 100 includes the switching circuit 19, the first frequency band can be switched by the switching circuit 19, and operation of the middle and high frequency bands is unaffected. The switching circuit 19 further includes the resonance circuit 195 and the current from the switching circuit 19 will flow to the gap 119 (e.g., path P4). Then the first branch B1 together with the resonance circuit 195 can further activate the fourth operation mode to generate radiation signals in the fourth frequency band.

Figure 14:
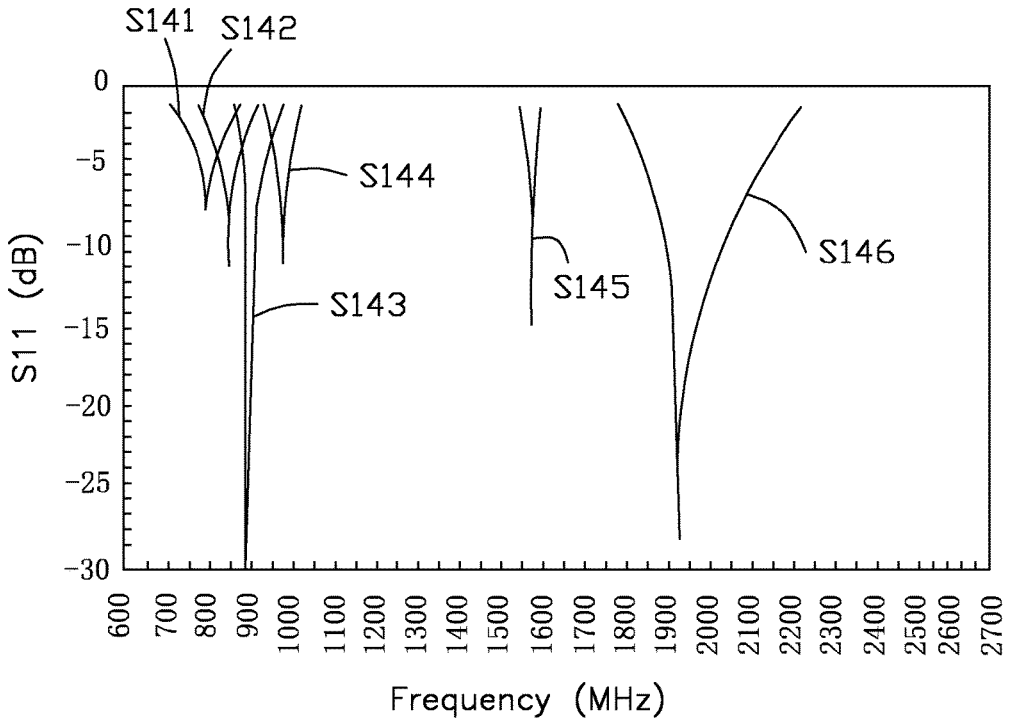
FIG. 14 is a scattering parameter graph when the antenna structure of FIG. 1 works at a low frequency operation mode, a Global Positioning System (GPS) operation mode, and a middle frequency operation mode.

FIG. 14 illustrates a scattering parameter graph of the antenna structure 100, when the antenna structure 100 works at the low frequency operation mode, the GPS operation mode, and the middle frequency operation mode. Curve S141 illustrates a scattering parameter when the antenna structure 100 works at a frequency band of about LTE-A 734-756 MHz. Curve S142 illustrates a scattering parameter when the antenna structure 100 works at a frequency band of about LTE-A 791-821 MHz. Curve S143 illustrates a scattering parameter when the antenna structure 100 works at a frequency band of about LTE-A 869-894 MHz. Curve S144 illustrates a scattering parameter when the antenna structure 100 works at a frequency band of about LTE-A 925-960 MHz. Curve S145 illustrates a scattering parameter when the antenna structure 100 works at a frequency band of about 1575 MHz. Curve S146 illustrates a scattering parameter when the antenna structure 100 works at a frequency band of about LTE-A 1805-2170 MHz. In this exemplary embodiment, curves S141 to S144 respectively correspond to four different frequency bands and respectively correspond to four of the plurality of low frequency bands of the switching circuit 19.

Figure 15:
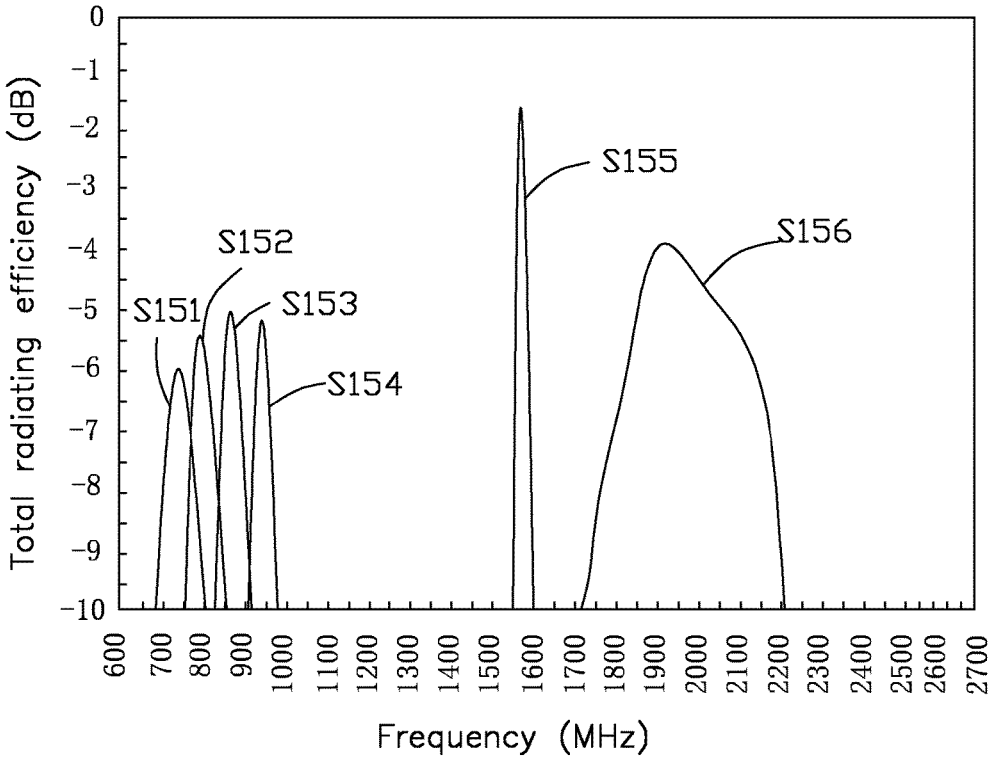
FIG. 15 is a total radiating efficiency graph when the antenna structure of FIG. 1 works at the low frequency operation mode, the GPS operation mode, and the middle frequency operation mode.

FIG. 15 illustrates a total radiating efficiency graph of the antenna structure 100, when the antenna structure 100 works at the low frequency operation mode, the GPS operation mode, and the middle frequency operation mode. Curve S151 illustrates a total radiating efficiency when the antenna structure 100 works at a frequency band of about LTE-A 734-756 MHz. Curve S152 illustrates a total radiating efficiency when the antenna structure 100 works at a frequency band of about LTE-A 791-821 MHz. Curve S153 illustrates a total radiating efficiency when the antenna structure 100 works at a frequency band of about LTE-A 869-894 MHz. Curve S154 illustrates a total radiating efficiency when the antenna structure 100 works at a frequency band of about LTE-A 925-960 MHz. Curve S155 illustrates a total radiating efficiency when the antenna structure 100 works at a frequency band of about 1575 MHz. Curve S156 illustrates a total radiating efficiency when the antenna structure 100 works at a frequency band of about LTE-A 1805-2170 MHz. In this exemplary embodiment, curves S151 to S154 respectively correspond to four different frequency bands and respectively correspond to four of the plurality of low frequency bands of the switching circuit 19.

Figure 16:
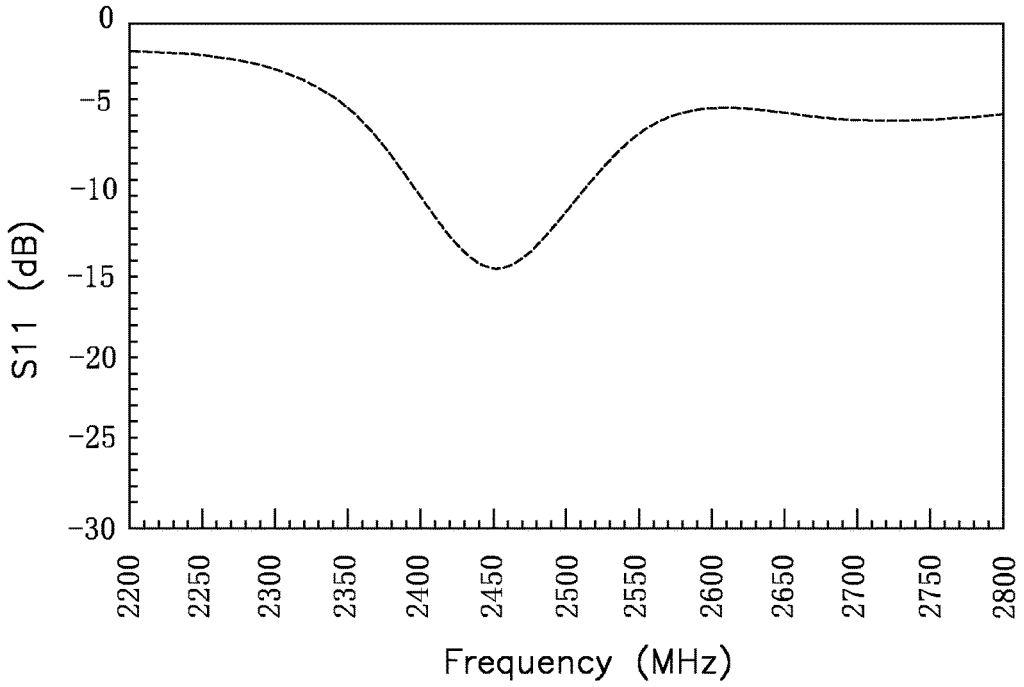
FIG. 16 is a scattering parameter graph when the antenna structure of FIG. 1 works at a high frequency operation mode and a WIFI 2.4 GHz operation mode.
Figure 17:
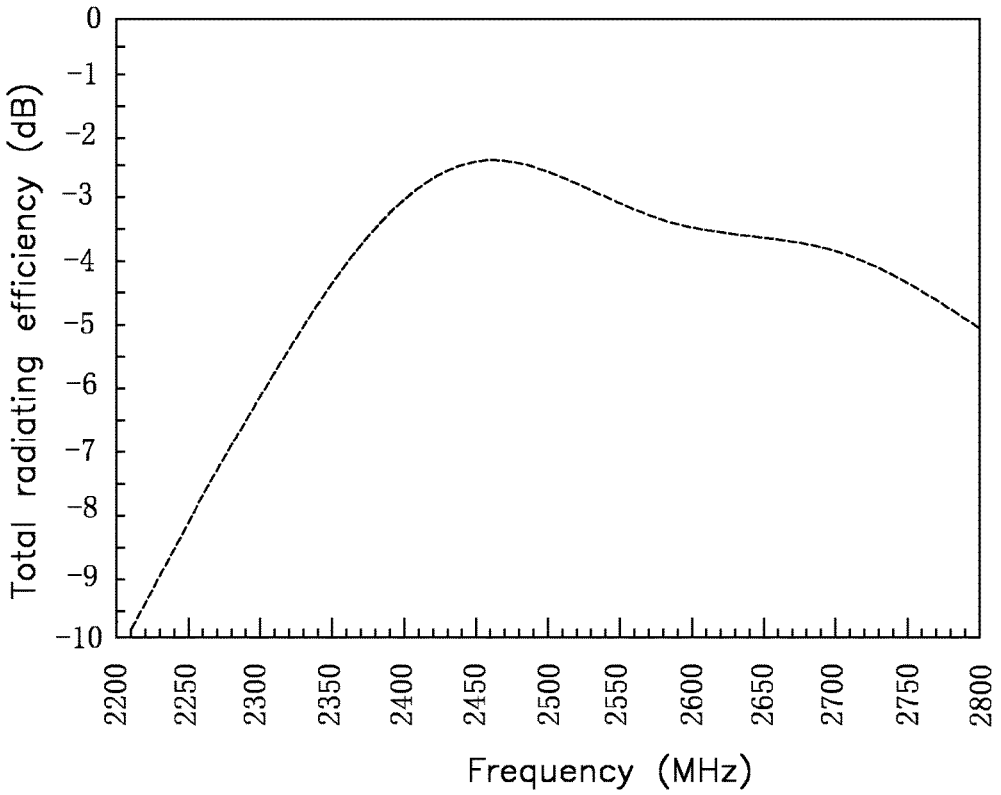
FIG. 17 is a total radiating efficiency graph when the antenna structure of FIG. 1 works at a high frequency operation mode and a WIFI 2.4 GHz operation mode.

FIG. 16 illustrates a scattering parameter graph of the antenna structure 100, when the antenna structure 100 works at the high frequency operation mode (LTE-A 2300-2400 MHz and LTE-A 2496-2690 MHz) and the WIFI 2.4 GHz operation mode. FIG. 17 illustrates a total radiating efficiency graph of the antenna structure 100, when the antenna structure 100 works at the high frequency operation mode (LTE-A 2300-2400 MHz and LTE-A 2496-2690 MHz) and the WIFI 2.4 GHz operation mode.

Per FIGS. 14 to 17, the antenna structure 100 can work at a low frequency band, for example, LTE-A 734-960 MHz).

The antenna structure 100 can also work at a GPS band, a middle frequency band (LTE-A 1805-2170 MHz), a high frequency band (LTE-A 2300-2400 MHz and LTE-A 2496-2690 MHz), and a WIFI 2.4 GHz band. That is, the antenna structure 100 can work at the low, middle, high frequency bands, GPS band, and WIFI 2.4 GHz band, and when the antenna structure 100 works at these frequency bands, a working frequency satisfies a design of the antenna and also has a good radiating efficiency.

As described above, the antenna structure 100 defines the slot 118, the gap 119, and the groove 120. The front frame 111 can be divided into a first radiating portion A1, the first branch B1 and the second branch B2 of the second radiating portion A2. The antenna structure 100 further includes the first feed source 13 and the second feed source 15. The first feed source 13 supplies current to the first branch B1 and the second branch B2 of the second radiating portion A2. The second feed source 15 supplies current to the first radiating portion A1. Then the first branch B1 of the second radiating portion A2 can activate a first operation mode to generate radiation signals in a low frequency band, the second branch B2 of the second radiating portion A2 can activate a second operation mode to generate radiation signals in a middle frequency band, and the first radiating portion A1 can activate a third operation mode to generate radiation signals in a high frequency band. The wireless communication device 400 can use carrier aggregation (CA) technology of LTE-A to receive or send wireless signals at multiple frequency bands simultaneously.

In addition, the antenna structure 100 includes the housing 11. The slot 118, the gap 119, and the groove 120 of the housing 11 are all defined on the front frame 111 and the side frame 113 instead of the backboard 112. Then the backboard 112 forms an all-metal structure. That is, the backboard 112 does not define any other slot and/or gap and has a good structural integrity and an aesthetic quality.

Exemplary Embodiment 2

Figure 18:
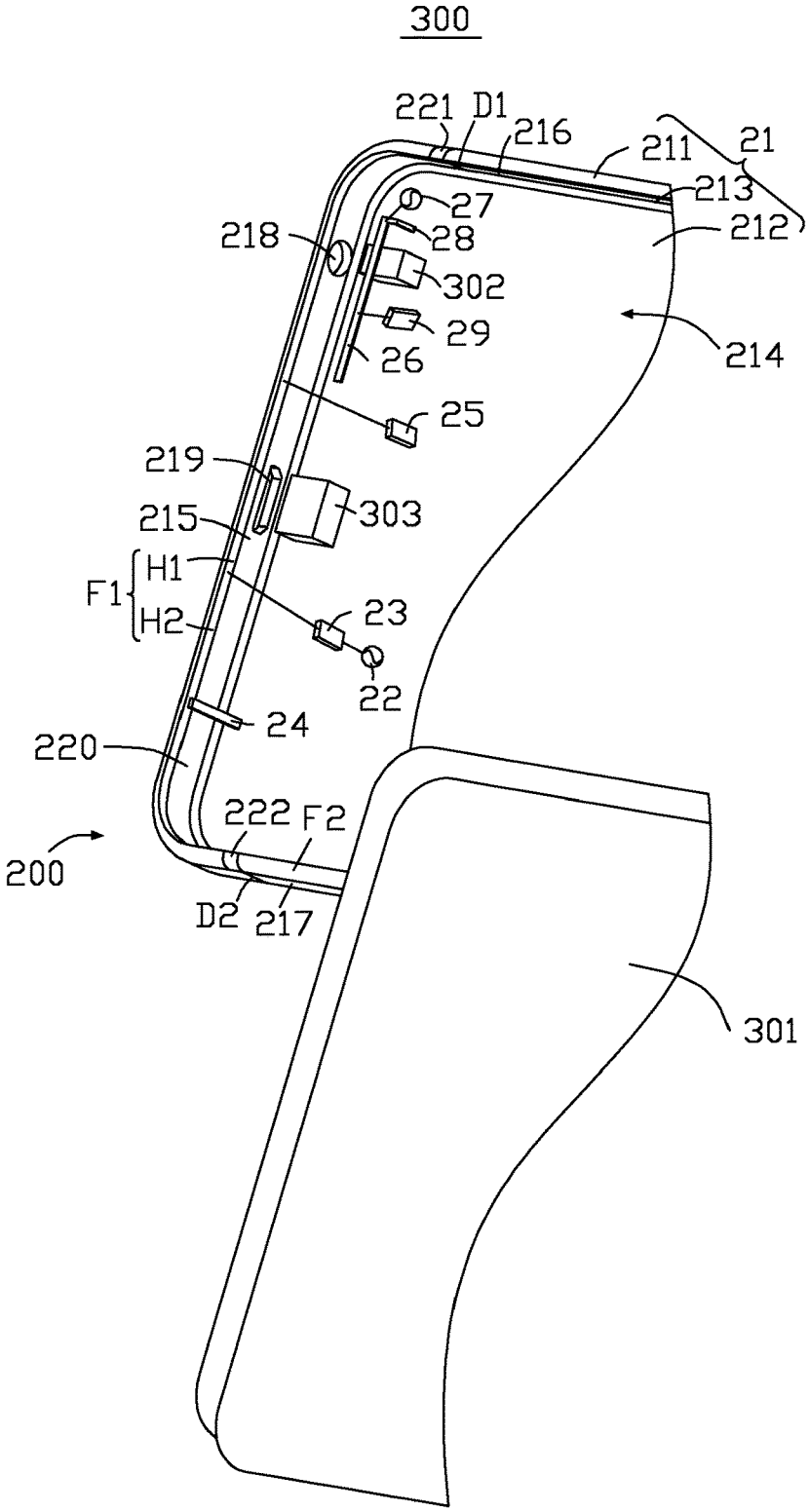
FIG. 18 is an isometric view of a second exemplary embodiment of a wireless communication device using a second exemplary antenna structure.

FIG. 18 illustrates an embodiment of a wireless communication device 300 using a second exemplary antenna structure 200. The wireless communication device 300 can be a mobile phone or a personal digital assistant, for example. The antenna structure 200 can receive and/or transmit wireless signals.

Figure 19:
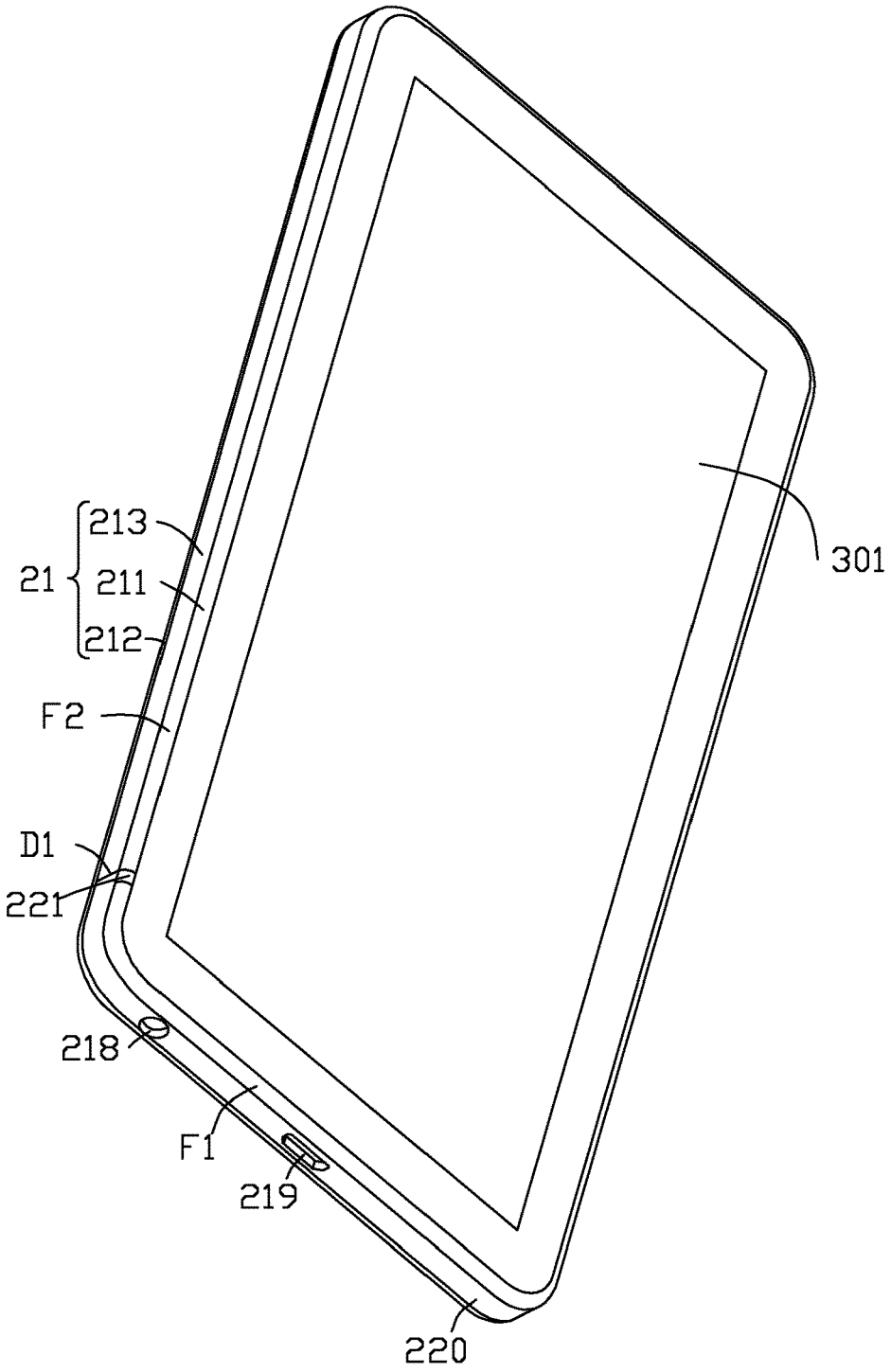
FIG. 19 is an assembled, isometric view of the wireless communication device of FIG. 18.
Figure 20:
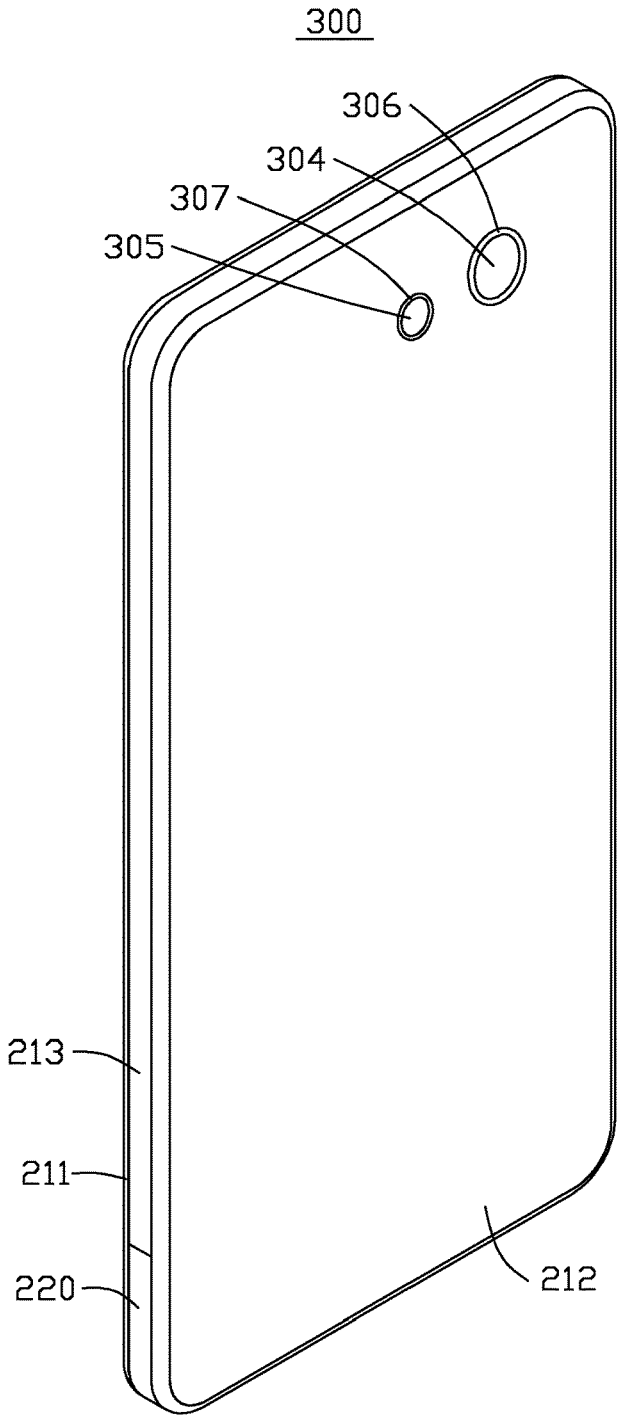
FIG. 20 is a circuit diagram of the antenna structure of FIG. 18.

Per FIG. 19 and FIG. 20, the antenna structure 200 includes a housing 21, a first feed source 22, a matching circuit 23, and a first ground portion 24. The housing 21 can be a metal housing of the wireless communication device 300. In this exemplary embodiment, the housing 21 is made of metallic material. The housing 21 includes a front frame 211, a backboard 212, and a side frame 213. The front frame 211, the backboard 212, and the side frame 213 can be integral with each other. The front frame 211, the backboard 212, and the side frame 213 cooperatively form the housing of the wireless communication device 300.

The front frame 211 defines an opening (not shown). The wireless communication device 300 includes a display 301. The display 301 is received in the opening. The display 301 has a display surface. The display surface is exposed at the opening and is positioned parallel to the backboard 212.

Figure 21:
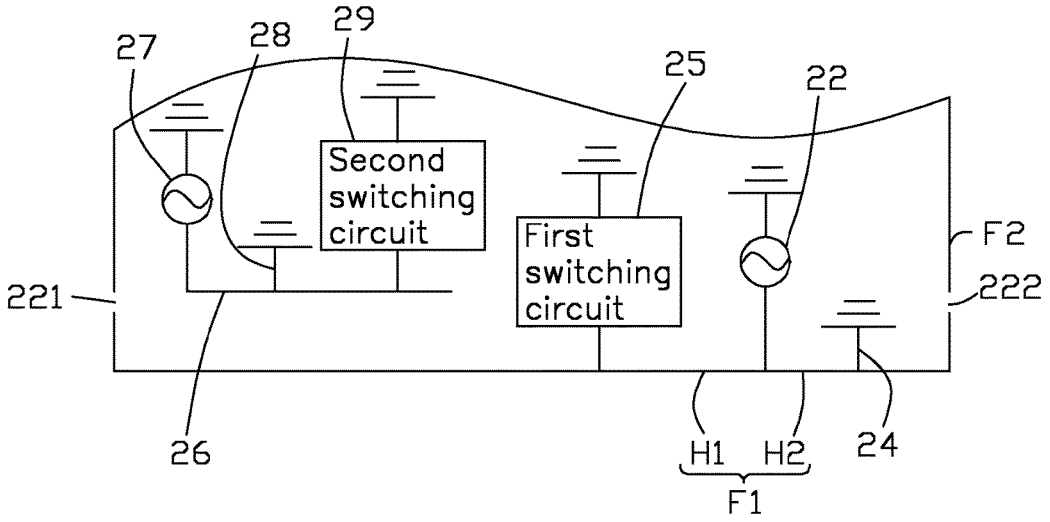
FIG. 21 is similar to FIG. 19, but shown from another angle.

Per FIG. 21, the backboard 212 is positioned opposite to the front frame 211. The backboard 212 is directly connected to the side frame 213 and there is no gap between the backboard 212 and the side frame 213. The backboard 212 is an integral and single metallic sheet. Except for the holes 306 and 307 exposing a camera lens 304 and a flash light 305, the backboard 212 does not define any other slot, break line, and/or gap. The backboard 212 serves as the ground of the antenna structure 200 and the wireless communication device 300.

The side frame 213 is positioned between the backboard 212 and the front frame 211. The side frame 213 is positioned around a periphery of the backboard 212 and a periphery of the front frame 211. The side frame 213 forms a receiving space 214 together with the display 301, the front frame 211, and the backboard 212. The receiving space 214 can receive a printed circuit board, a processing unit, or other electronic components or modules.

The side frame 213 includes an end portion 215, a first side portion 216, and a second side portion 217. In this exemplary embodiment, the end portion 215 can be a bottom portion of the wireless communication device 300. The end portion 215 connects the front frame 211 and the backboard 212. The first side portion 216 is positioned apart from and parallel to the second side portion 217. The end portion 215 has first and second ends. The first side portion 216 is connected to the first end of the first frame 211 and the second side portion 217 is connected to the second end of the end portion 215. The first side portion 216 and the second side portion 217 both connect to the front frame 211.

The side frame 213 defines a first through hole 218, a second through hole 219, and a slot 220. The front frame 211 defines a first gap 221 and a second gap 222. In this exemplary embodiment, the first through hole 218 and the second through hole 219 are both defined on the end portion 215. The first through hole 218 and the second through hole 219 are spaced apart from each other and penetrate the end portion 215.

The wireless communication device 300 includes at least one electronic element. In this exemplary embodiment, the wireless communication device 300 includes a first electronic element 302 and a second electronic element 303. In this exemplary embodiment, the first electronic element 302 is an earphone interface module. The first electronic element 302 is positioned in the receiving space 214 adjacent to the first side portion 216. The first electronic element 302 corresponds to the first through hole 218 and is partially exposed from the first through hole 218. An earphone can thus be inserted in the first through hole 218 and be electrically connected to the first electronic element 302.

The second electronic element 303 is a Universal Serial Bus (USB) module. The second electronic element 303 is positioned in the receiving space 214 and is positioned between the first electronic element 302 and the second side portion 217. The second electronic element 303 corresponds to the second through hole 219 and is partially exposed from the second through hole 219. A USB device can be inserted in the second through hole 219 and be electrically connected to the second electronic element 303.

In this exemplary embodiment, the slot 220 is defined at the end portion 215. The slot 220 communicates with the first through hole 218 and the second through hole 219. The slot 220 further extends to the first side portion 216 and the second side portion 217.

The first gap 221 and the second gap 222 both communicate with the slot 220 and extend to cut across the front frame 211. In this exemplary embodiment, the first gap 221 is defined on the front frame 211 and communicates with a first end D1 of the slot 220 positioned on the first side portion 216. The second gap 222 is defined on the front frame 211 and communicates with a second end D2 of the slot 220 positioned on the second side portion 217.

The housing 21 is divided into two portions by the slot 220, the first gap 221, and the second gap 222. The two portions are a first portion F1 and a second portion F2. One portion of the housing 21 surrounded by the slot 220, the first gap 221, and the second gap 222 forms the first portion F1. The other portions of the housing 21 forms the second portion F2. The first portion F1 forms an antenna structure to receive and/or transmit wireless signals. The second portion F2 is grounded.

In this exemplary embodiment, the slot 220 is defined at the end of the side frame 213 adjacent to the backboard 212 and extends to an edge of the front frame 211. Then the first portion F1 is fully formed by a portion of the front frame 211. In other exemplary embodiments, a position of the slot 220 can be adjusted. For example, the slot 220 can be defined on the end of the side frame 213 adjacent to the backboard 212 and extend towards the front frame 211. Then the first portion F1 is formed by a portion of the front frame 211 and a portion of the side frame 213.

In other exemplary embodiments, the slot 220 is only defined at the end portion 215 and does not extend to any one of the first side portion 216 and the second side portion 217. In other exemplary embodiments, the slot 220 can be defined at the end portion 215 and extend to one of the first side portion 216 and the second side portion 217. Then, locations of the first gap 221 and the second gap 222 can be adjusted according to a position of the slot 220. For example, the first gap 221 and the second gap 222 can both be positioned at a location of the front frame 211 corresponding to the end portion 215. For example, one of the first gap 221 and the second gap 222 can be positioned at a location of the front frame 211 corresponding to the end portion 215. The other of the first gap 221 and the second gap 222 can be positioned at a location of the front frame 211 corresponding to the first side portion 216 or the second side portion 217. That is, a shape and a location of the slot 220, locations of the first gap 221 and the second gap 222 on the side frame 212 can be adjusted, to ensure that the housing 21 can be divided into the first portion F1 and the second portion F2 by the slot 220, the first gap 221, and the second gap 222.

In this exemplary embodiment, except for the first through hole 218 and the second through hole 219, the slot 220, the first gap 221, and the second gap 222 are all filled with insulating material, for example, plastic, rubber, glass, wood, ceramic, or the like, thereby isolating the first portion F1 and the second portion F2.

In this exemplary embodiment, the first feed source 22 is positioned in the receiving space 214. The first feed source 22 is positioned between the second electronic element 303 and the second side portion 217 adjacent to the second electronic element 303. The first feed source 22 is electrically connected to the first portion F1 through the matching circuit 23. The first feed source 22 supplies current to the first portion F1 and the first portion F1 is divided into two portions by the first feed source 22. The two portions include a first branch H1 and a second branch H2. A first portion of the front frame 211 extending from the first feed source 22 to the first gap 221 forms the first branch H1. A second portion of the front frame 211 extending from the first feed source 22 to the second gap 222 forms the second branch H2. In this exemplary embodiment, the first feed source 22 is not positioned at a middle portion of the first portion F1. The first branch H1 is longer than the second branch H2.

The first ground portion 24 is substantially rectangular and positioned in the receiving space 214. The first ground portion 24 is positioned between the first feed source 22 and the second side portion 217. One end of the first ground portion 24 is electrically connected to the second branch H2. Another end of the first ground portion 24 is electrically connected to the backboard 212 to be grounded and grounds the second branch H2.

In this exemplary embodiment, when the first feed source 22 supplies current, the current flows through the first branch H1 of the first portion F1 and flows towards the first gap 221. Then the first branch H1 activates a first operation mode for generating radiation signals in a first frequency band. In this exemplary embodiment, the first operation mode is a low frequency operation mode. The first frequency band is a frequency band of about LTE-A 704-960 MHz.

When the first feed source 22 supplies current, the current flows through the second branch H2 of the first portion F1, flows towards the second gap 222, and is grounded through the first ground portion 24. Then the second branch H2 activates a second operation mode for generating radiation signals in a second frequency band. In this exemplary embodiment, the second operation mode is a middle frequency operation mode. A frequency of the second frequency band is higher than a frequency of the first frequency band. The second frequency band is a frequency band of about 1710-1990 MHz.

In this exemplary embodiment, the antenna structure 200 further includes a first switching circuit 25. The first switching circuit 25 adjusts a bandwidth of the first frequency band, that is, the antenna structure 200 has a good bandwidth in the low frequency band. The first switching circuit 25 is positioned in the receiving space 214 and is positioned between the first electronic element 302 and the second electronic element 303. One end of the first switching circuit 25 is electrically connected to the first branch H1. Another end of the first switching circuit 25 is electrically connected to the backboard 212 to be grounded.

Figure 22:
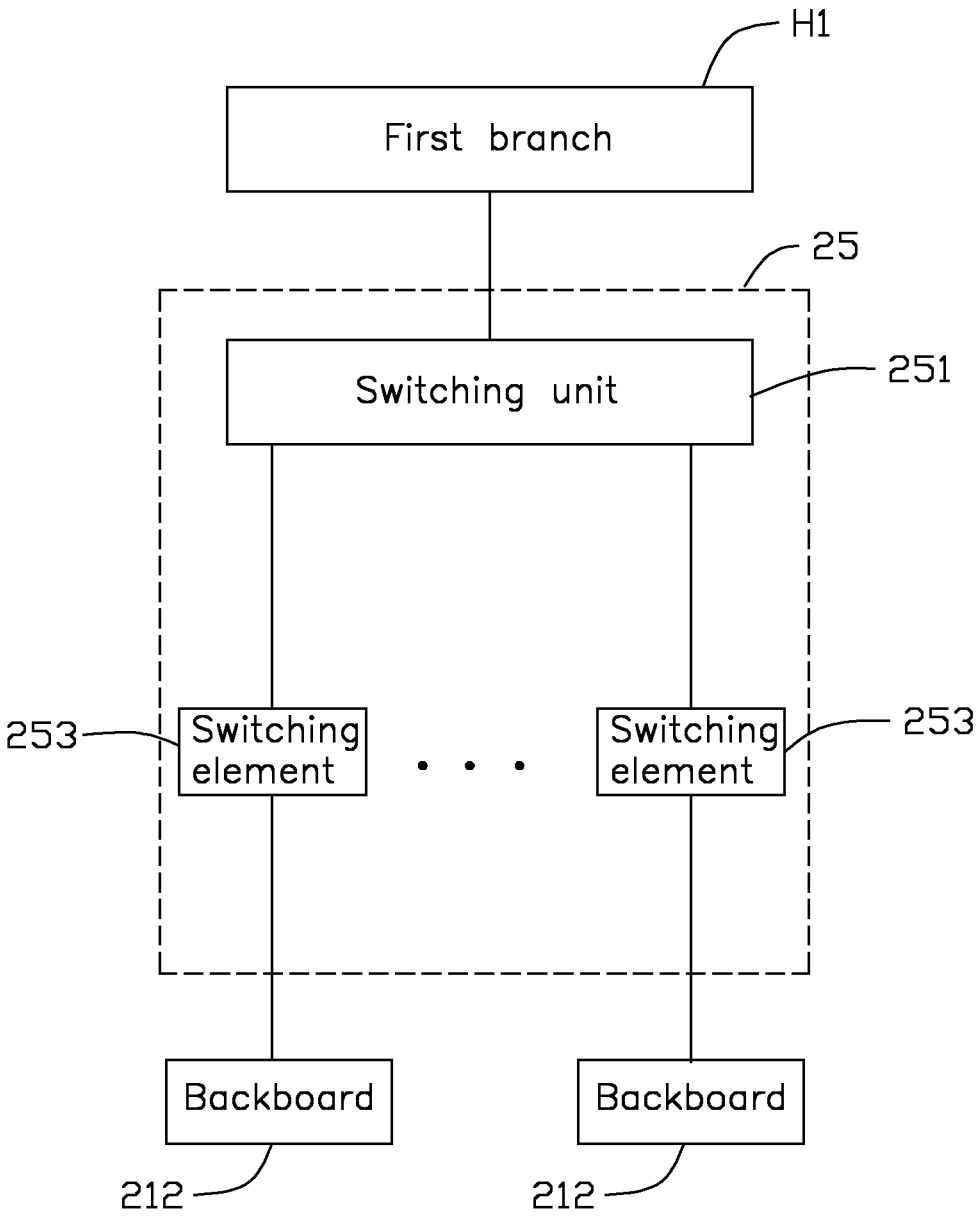
FIG. 22 is a circuit diagram of a first switching circuit of the antenna structure of FIG. 18.

Per FIG. 22, the first switching circuit 25 includes a switching unit 251 and a plurality of switching elements 253. The switching unit 251 is electrically connected to the first branch H1. The switching elements 253 can be an inductor, a capacitor, or a combination of the inductor and the capacitor. The switching elements 253 are connected in parallel. One end of each switching element 253 is electrically connected to the switching unit 251. The other end of each switching element 253 is electrically connected to the backboard 212.

Through control of the switching unit 251, the first branch H1 can be switched to connect with different switching elements 253. Since each switching element 253 has a different impedance, a first frequency band of the first mode of the first branch H1 can be thereby adjusted.

Figure 23:
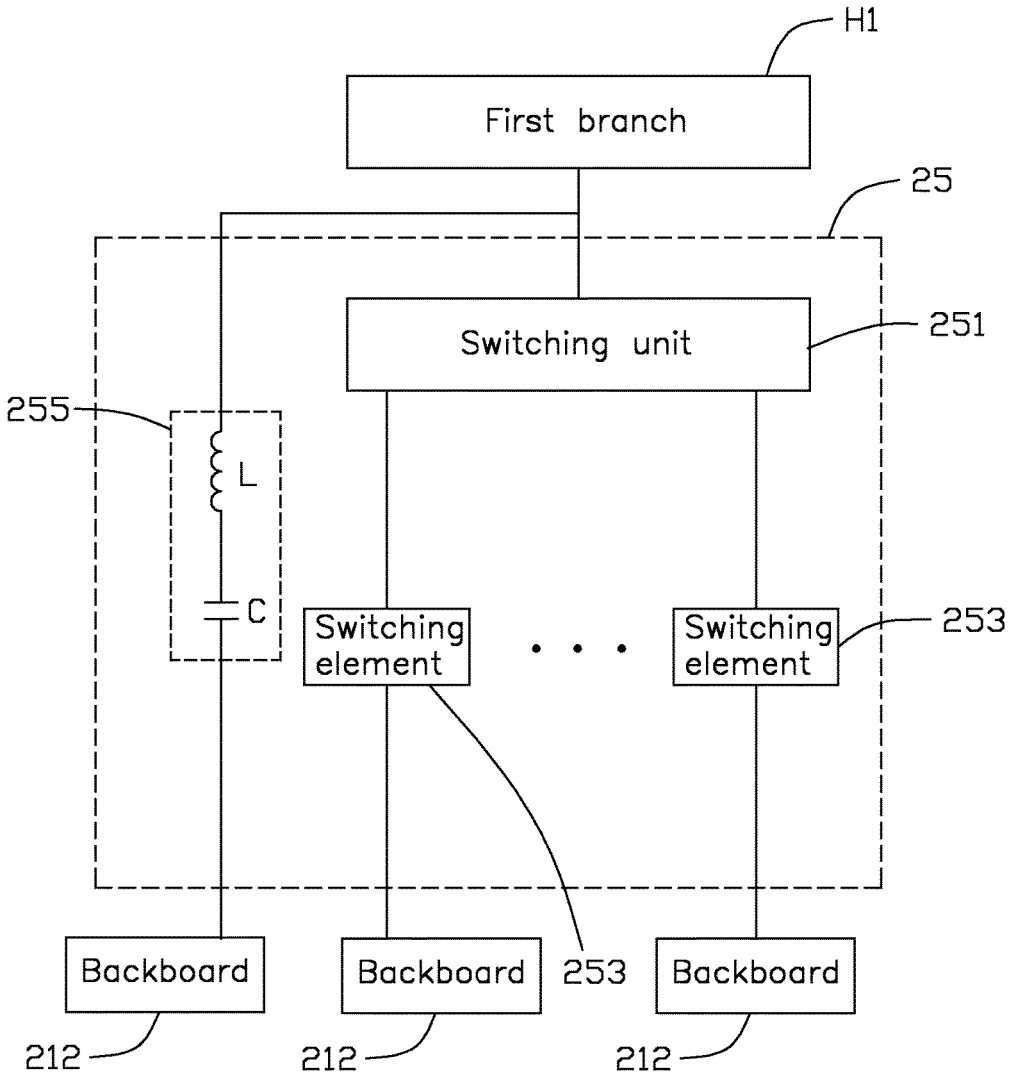
FIG. 23 is a circuit diagram of the first switching circuit of FIG. 22, showing the first switching circuit includes a resonance circuit.

In this exemplary embodiment, the first branch H1 can further activate a third operation mode to generate radiation signals in a third frequency band. Per FIG. 23 and FIG. 24, the first switching circuit 25 further includes a resonance circuit 255. Per FIG. 23, in one exemplary embodiment, the first switching circuit 25 includes one resonance circuit 255. The resonance circuit 255 includes an inductor L and a capacitor C connected in series. The resonance circuit 255 is electrically connected between the first branch H1 and the backboard 212. The resonance circuit 255 is connected in parallel to the switching unit 251 and at least one switching element 253.

Figure 24:
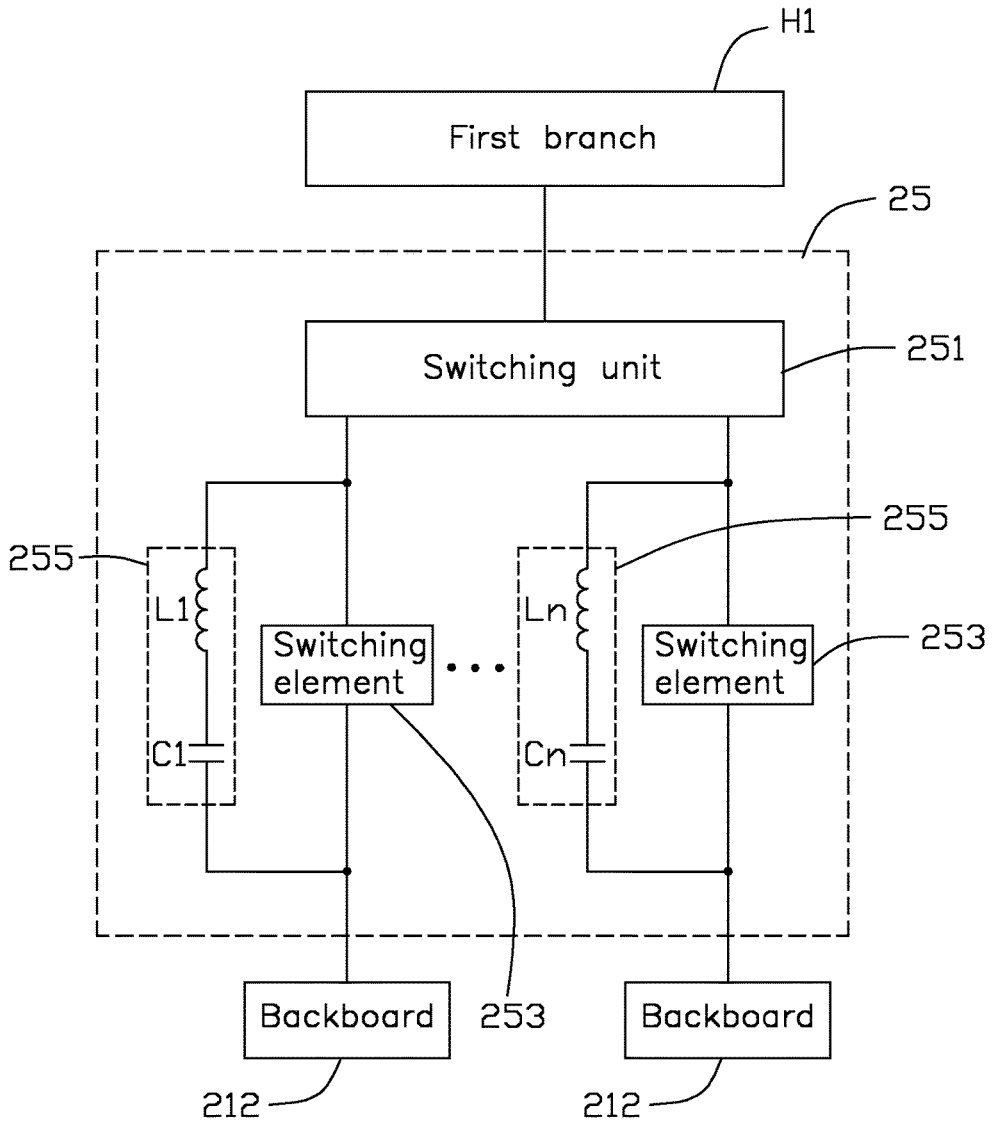
FIG. 24 is similar to FIG. 22, but shown the first switching circuit includes another resonance circuit.

Per FIG. 24, in another exemplary embodiment, the first switching circuit 25 includes a plurality of resonance circuits 255. The number of the resonance circuits 255 is equal to the number of switching elements 253. Each resonance circuit 255 includes inductors L1-Ln and capacitors C1-Cn connected in series. Each resonance circuit 255 is electrically connected in parallel to one of the switching elements 253 between the switching unit 251 and the backboard 212.

Figure 25:
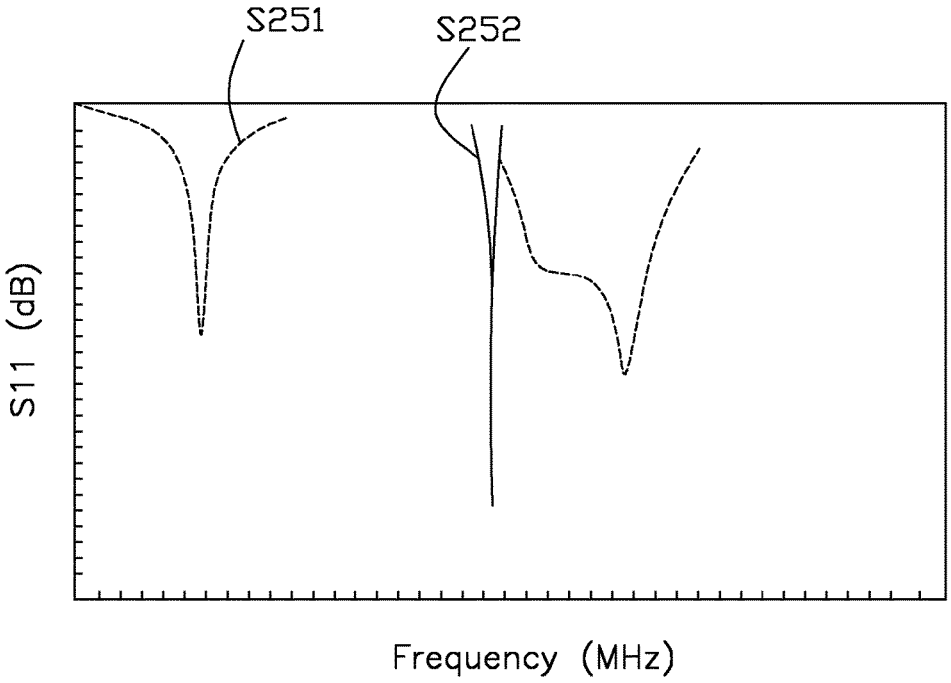
FIG. 25 is a schematic diagram of the antenna structure of FIG. 18, showing the first switching circuit of FIG. 23 includes a resonance circuit and generates a resonance mode.

Per FIG. 25, when the first switching circuit 25 does not include the resonance circuit 255, the first branch H1 of the antenna structure 200 works at the first operation mode (please see the curve S251). When the first switching circuit 25 includes the resonance circuit 255, the first branch H1 of the antenna structure 200 can activate an additional resonance mode (that is, the third operation mode, per curve S252) to generate radiation signals in the third frequency band. The third operation mode can effectively broaden an applied frequency band of the antenna structure 200. In one exemplary embodiment, the third frequency band is a middle frequency band and the third operation mode is the middle frequency resonance mode. A frequency of the third frequency band is higher than a frequency of the second frequency band. The third frequency band is a frequency band of about 2110-2170 MHz.

Figure 26:
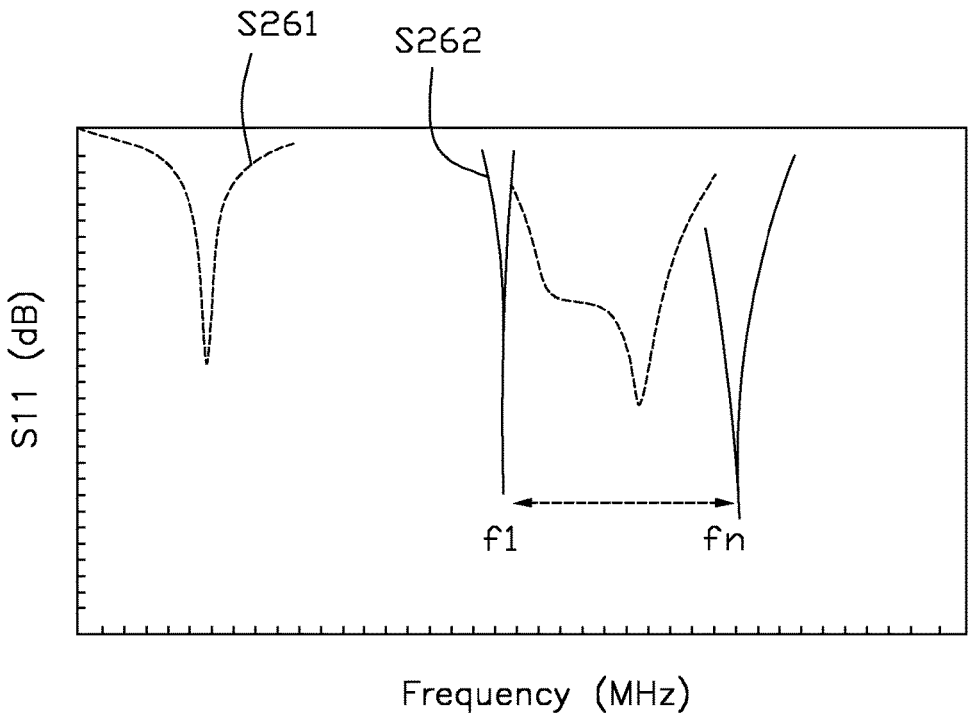
FIG. 26 is a schematic diagram of the antenna structure of FIG. 18, showing the first switching circuit of FIG. 24 includes a resonance circuit and generates a resonance mode.

Per FIG. 26, when the first switching circuit 25 does not include the resonance circuit 255 of FIG. 24, the first branch H1 of the antenna structure 200 works at the first operation mode (per curve S261). When the first switching circuit 25 includes the resonance circuit 255, the first branch H1 of the antenna structure 200 can activate the additional resonance mode (per curve S262), that is, the middle frequency resonance mode. The resonance mode can effectively broaden an applied frequency band of the antenna structure 200. In one exemplary embodiment, an inductance value of the inductors L1-Ln and a capacitance value of the capacitors C1-Cn of the resonance circuit 255 can cooperatively decide a frequency band of the resonance mode when the first operation mode switches. For example, in one exemplary embodiment, as illustrated in FIG. 26, when the switching unit 251 switches to different switching elements 253 through setting the inductance value and the capacitance value of the resonance circuit 255, the resonance mode of the antenna structure 200 can also be switched. For example, the resonance mode of the antenna structure 200 can be moved from f1 to fn.

In other exemplary embodiments, the frequency band of the resonance mode can be fixed through setting the inductance value and the capacitance value of the resonance circuit 255. Then no matter to which switching element 253 the switching unit 251 is switched, the frequency band of the resonance mode is fixed and keeps unchanged.

Figure 27:
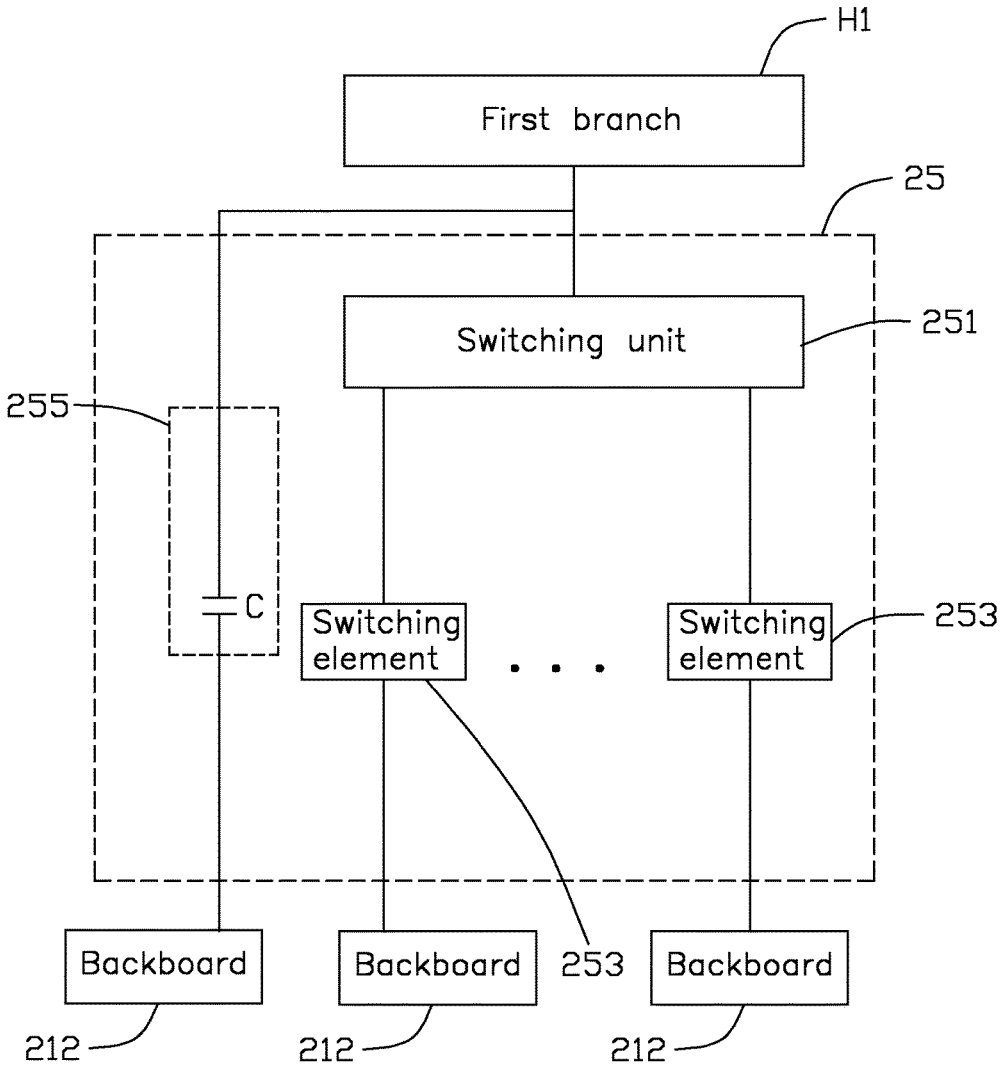
FIG. 27 is similar to FIG. 23, but shown the first switching circuit includes another resonance circuit.
Figure 28:
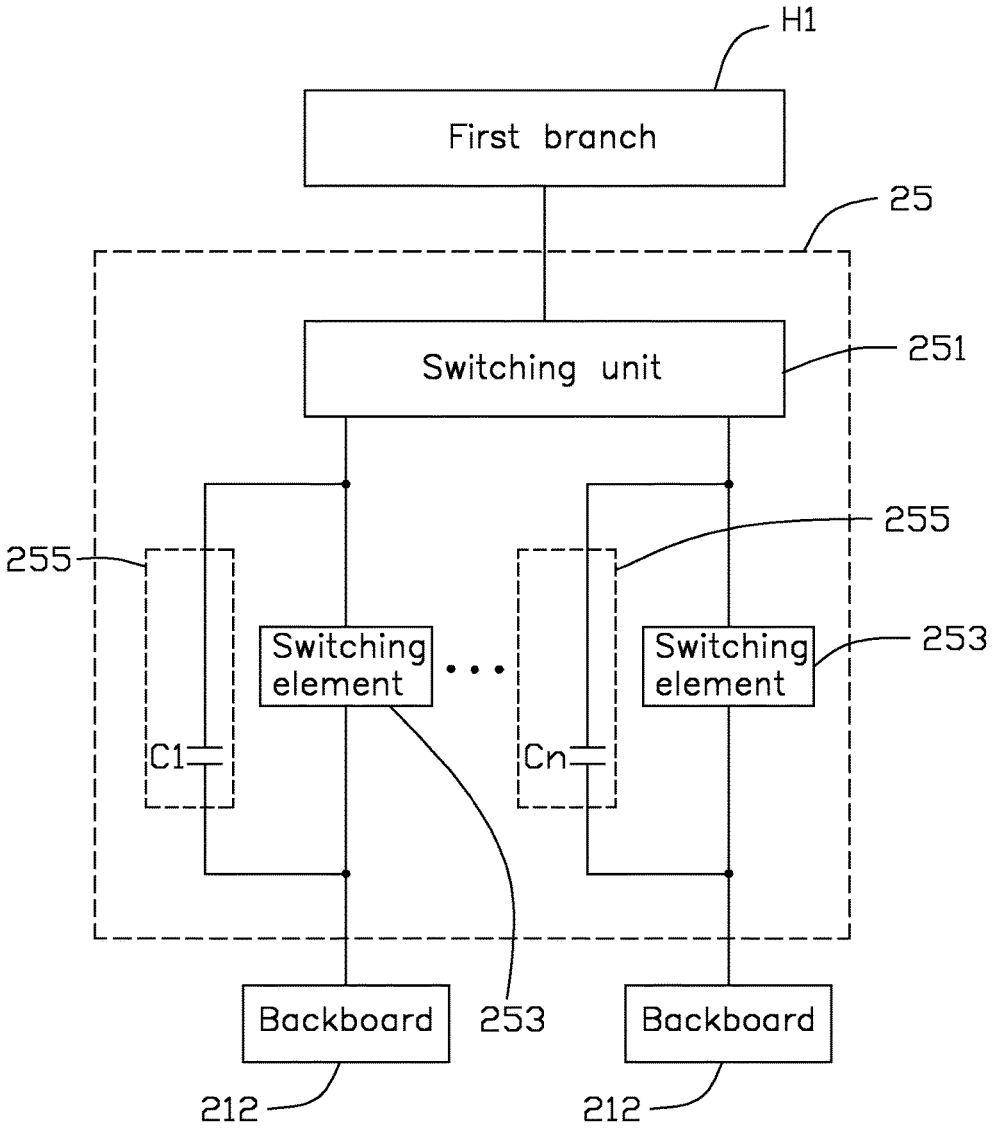
FIG. 28 is similar to FIG. 24, but shown the first switching circuit includes another resonance circuit.
Figure 29:
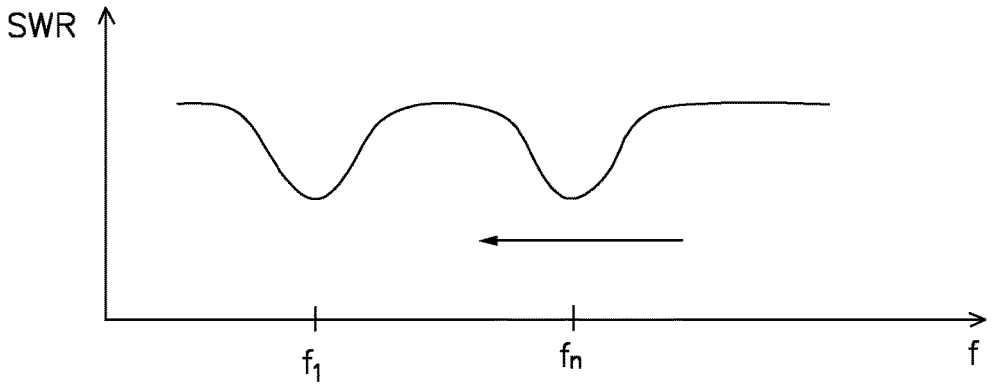
FIG. 29 is a schematic diagram of the antenna structure of FIG. 18, showing the switching circuit of FIGS. 27-28 include a resonance circuit and generates a resonance mode.

In other exemplary embodiments, the resonance circuit 255 is not limited including only the inductors L1-Ln and the capacitors C1-Cn, other resonance components can be included. For example, per FIG. 27 and FIG. 28, in other exemplary embodiments, the resonance circuit 255 includes only one capacitor C or capacitors C1-Cn. Then, per FIG. 29, when the capacitance value of the capacitor C or capacitors C1-Cn is changed, a double frequency mode fh of the resonance mode f1 can also be moved effectively.

Per FIG. 18, in other exemplary embodiments, the antenna structure 200 further includes a radiator 26, a second feed source 27, a second ground portion 28, and a second switching circuit 29.

In this exemplary embodiment, the radiator 26 is positioned in the receiving space 214 adjacent to the first gap 221. The radiator 26 is spaced apart from the backboard 212. The radiator 26 is substantially rectangular. The radiator 26 passes over the first electronic element 302 and is spaced apart from the first electronic element 302. The radiator 26 is positioned adjacent to the first electronic element 302 and extends along a direction parallel to the end portion 215 towards the second side portion 217. The extension continues until the radiator 26 passes over the first electronic element 302 and further extends along a direction parallel to the end portion 215 towards the second side portion 217.

The second feed source 27 is positioned between the first side portion 216 and the first electronic element 302. One end of the second feed source 27 is electrically connected to the end of the radiator 26 adjacent to the second ground portion 28. Another end of the second feed source 27 is electrically connected to the backboard 212 to be grounded and grounds the radiator 26. When the second feed source 27 supplies current, the current flows through the radiator 26. The radiator 26 activates a fourth operation mode to generate radiation signals in a fourth frequency band. In this exemplary embodiment, the fourth operation mode is a high frequency operation mode. A frequency of the fourth frequency band is higher than a frequency of the third frequency band.

The second feed source 27 and the second ground portion 28 are positioned at the side of the first electronic element 302 adjacent to the second side portion 217. One end of the second switching circuit 29 is electrically connected to the middle position of the radiator 26. Another end of the second switching circuit 29 is electrically connected to the backboard 212 to be grounded. The second switching circuit 29 adjusts a frequency band of the high frequency operation mode of the radiator 26 and the high frequency operation mode can contain frequency bands of about LTE-A 2300-2400 MHz and LTE-A 2496-2690 MHz, that is LTE-A 2300-2690 MHz. A circuit structure and a working principle of the second switching circuit 29 are consistent with the first switching circuit 25 shown in FIG. 22.

Figure 30:
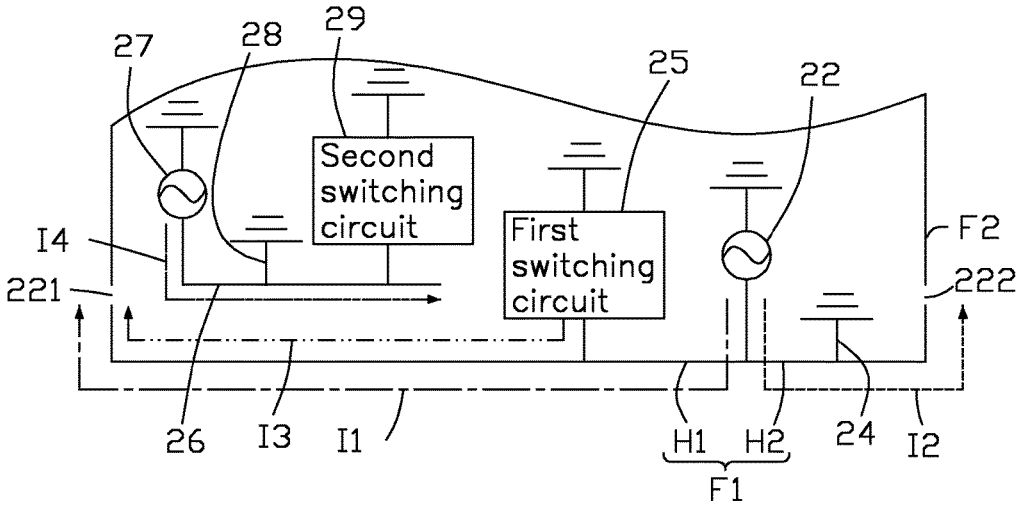
FIG. 30 is a current path distribution graph of the antenna structure of FIG. 18.

Per FIG. 30, when the first feed source 22 supplies current, the current flows through the first branch H1 and flows towards the first gap 221 (e.g., path I1) to activate the first operation mode, to generate radiation signals in the first frequency band. When the first feed source 22 supplies current, the current flows through the second branch H2, flows towards the second gap 222, and is grounded through the first ground portion 24 (e.g., path I2) to activate the second operation mode to generate radiation signals in the second frequency band.

When the second feed source 15 supplies current, the current flows through the first radiating portion A1 and flows to the gap 119 (e.g., path P3) to activate the third operation mode, to generate radiation signals in the third frequency band. Since the antenna structure 200 includes the first switching circuit 25, the first frequency band can be switched by the first switching circuit 25, and operation of the middle and high frequency bands is not affected.

The antenna structure 200 further includes the resonance circuit 255 and the current from the first branch H1 will flow through the resonance circuit 255 of the first switching circuit 25, and flow towards the first gap 221 (e.g., path I3). Then the first branch H1 together with the resonance circuit 255 can further activate the third operation mode to generate radiation signals in the third frequency band. When the second feed source 27 supplies current, the current flows through the radiator 26 (e.g., path I4) to activate the fourth operation mode to generate radiation signals in the fourth frequency band. In relation to FIG. 22 and FIG. 30, the backboard 212 serves as the ground of the antenna structure 200.

In this exemplary embodiment, the backboard 212 serves as the ground of the antenna structure 200 and the wireless communication device 300. In other exemplary embodiments, the wireless communication device 300 further includes a shielding mask or a middle frame (not shown).

The shielding mask is positioned at the surface of the display towards the backboard 212 and shields against electromagnetic interference. The middle frame is positioned at the surface of the display towards the backboard 212 and supports the display. The shielding mask or the middle frame is made of metallic material. The shielding mask or the middle frame can be electrically connected to the backboard 212 to serve as the ground of the antenna structure 200 and wireless communication device 300. In each above ground point, the backboard 212 can be replaced by the shielding mask or the middle frame to ground the antenna structure 200 or wireless communication device 300.

Figure 31:
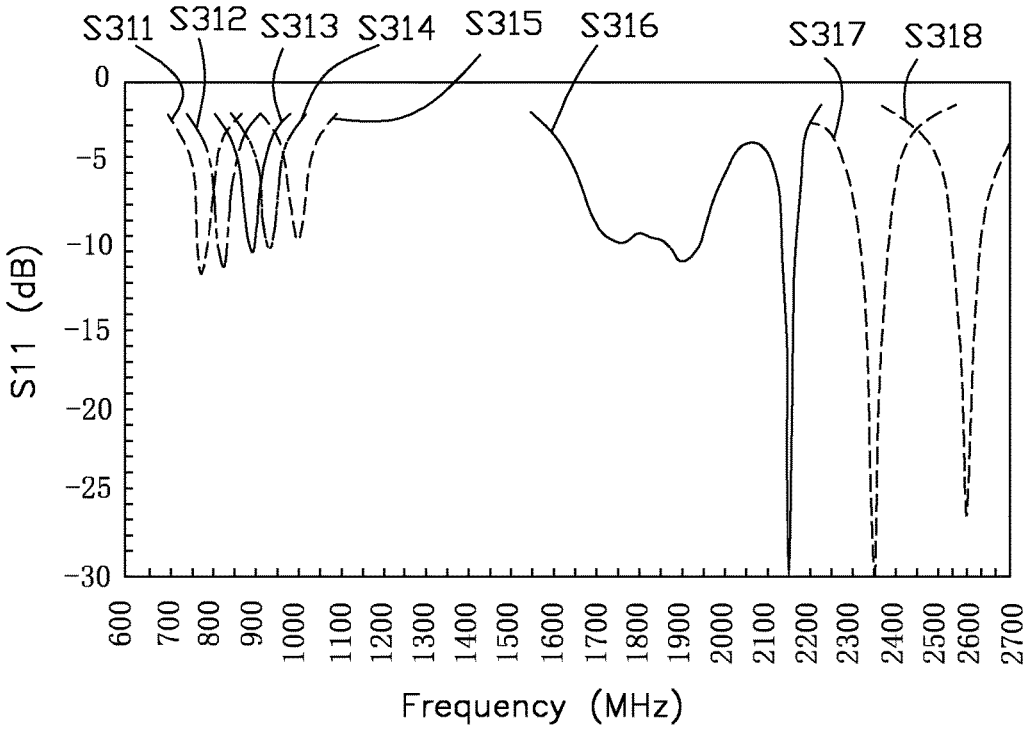
FIG. 31 is a scattering parameter graph when the antenna structure of FIG. 18 works at low, middle, and high frequency operation modes.

FIG. 31 illustrates a scattering parameter graph of the antenna structure 200, when the antenna structure 200 works at the LTE-A low, middle, and high frequency operation modes. Curve S311 illustrates a scattering parameter when the antenna structure 200 works at a frequency band of about 704-746 MHz. Curve S312 illustrates a scattering parameter when the antenna structure 200 works at a frequency band of about 746-787 MHz. Curve S313 illustrates a scattering parameter when the antenna structure 200 works at a frequency band of about 791-862 MHz. Curve S314 illustrates a scattering parameter when the antenna structure 200 works at a frequency band of about 824-894 MHz. Curve S315 illustrates a scattering parameter when the antenna structure 200 works at a frequency band of about 880-960 MHz. Curve S316 illustrates a scattering parameter when the antenna structure 200 works at a frequency band of about 1710-2170 MHz. Curve S317 illustrates a scattering parameter when the antenna structure 200 works at a frequency band of about 2300-2400 MHz. Curve S318 illustrates a scattering parameter when the antenna structure 200 works at a frequency band of about 2500-2690 MHz. In this exemplary embodiment, curves S311 to S315 respectively correspond to five different frequency bands and respectively correspond to five of the plurality of low frequency bands of the first switching circuit 25.

Figure 32:
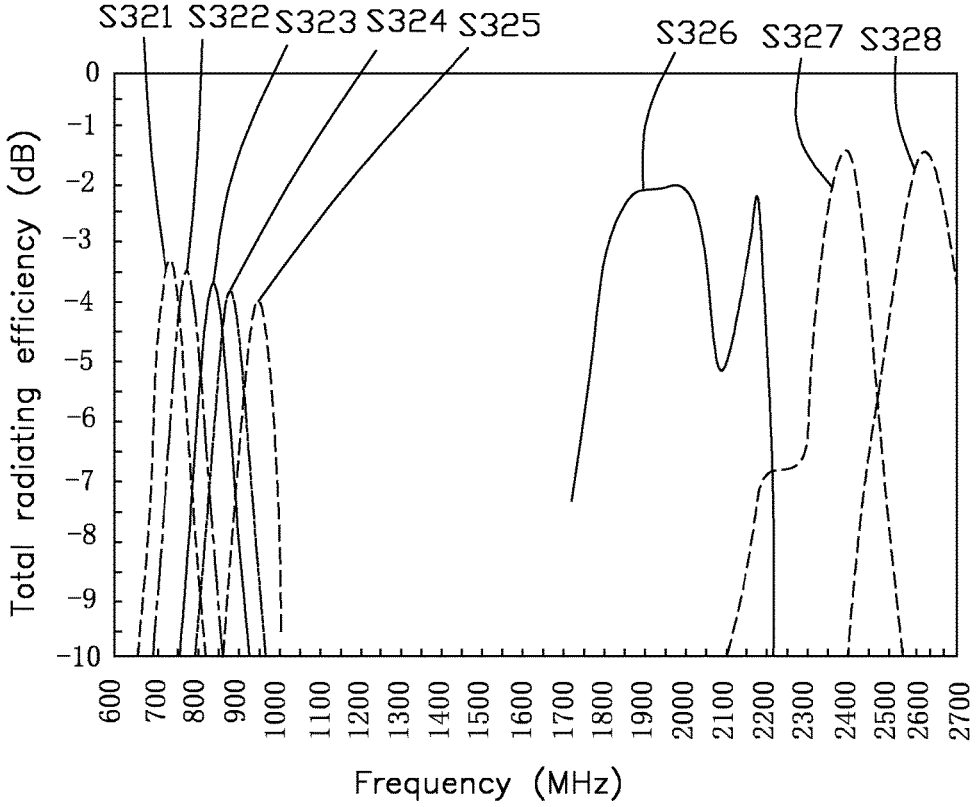
FIG. 32 is a total radiating efficiency graph when the antenna structure of FIG. 18 works at low, middle, and high frequency operation modes.

FIG. 32 illustrates a total radiating efficiency graph of the antenna structure 200, when the antenna structure 200 works at the LTE-A low, middle, and high frequency operation modes. Curve S321 illustrates a total radiating efficiency when the antenna structure 200 works at a frequency band of about 704-746 MHz. Curve S322 illustrates a total radiating efficiency when the antenna structure 200 works at a frequency band of about 746-787 MHz. Curve S323 illustrates a total radiating efficiency when the antenna structure 200 works at a frequency band of about 791-862 MHz. Curve S324 illustrates a total radiating efficiency when the antenna structure 200 works at a frequency band of about 824-894 MHz. Curve S325 illustrates a total radiating efficiency when the antenna structure 200 works at a frequency band of about 880-960 MHz. Curve S326 illustrates a total radiating efficiency when the antenna structure 200 works at a frequency band of about 1710-2170 MHz. Curve S327 illustrates a total radiating efficiency when the antenna structure 200 works at a frequency band of about 2300-2400 MHz. Curve S328 illustrates a total radiating efficiency when the antenna structure 200 works at a frequency band of about 2500-2690 MHz. In this exemplary embodiment, curves S321 to S325 respectively correspond to five different frequency bands and respectively correspond to five of the plurality of low frequency bands of the first switching circuit 25.

Per FIGS. 31 to 32, the antenna structure 200 can work at a low frequency band, for example, 704-960 MHz. The antenna structure 200 can also work at a middle frequency band (1710-2170 MHz), and a high frequency band (2300-2400 MHz and 2500-2690 MHz). That is, the antenna structure 200 can work at the low, middle, high frequency bands, and when the antenna structure 200 works at these frequency bands, a working frequency satisfies a design of the antenna and also has a good radiating efficiency.

As described above, the antenna structure 200 defines the slot 220, the first gap 221, and the second gap 222. The front frame 211 can be divided into a first portion F1 and the second portion F2. The antenna structure 200 further includes the first feed source 22 and the first portion F1 is further divided into the first branch H1 and the second branch H2. The first feed source 22 supplies current to the first branch H1 and the second branch H2 respectively. Then the first branch H1 can activate a first operation mode to generate radiation signals in a low frequency band and the second branch H2 can activate a second operation mode to generate radiation signals in a middle frequency band. In addition, the first branch H1 together with the resonance circuit 255 can further activate a third operation mode to generate radiation signals in a third frequency band. The antenna structure 200 further includes the radiator 26 and the second feed source 27. Then the radiator 26 can activate a fourth operation mode to generate radiation signals in a fourth frequency band. The wireless communication device 300 can use carrier aggregation (CA) technology of LTE-A and at least two of the radiator 26, the first branch H1, and the second branch H2 to receive or send wireless signals at multiple frequency bands simultaneously.

In addition, the antenna structure 200 includes the housing 21. The first through hole 218, the second through hole 219, the slot 220, the first gap 221, and the second gap 222 of the housing 21 are all defined on the front frame 211 and the side frame 213 instead of the backboard 212. Then the backboard 212 forms an all-metal structure. That is, the backboard 212 does not define any other slot and/or gap and has a good structural integrity and an aesthetic quality.

Exemplary Embodiments 3, 4

Figure 33:
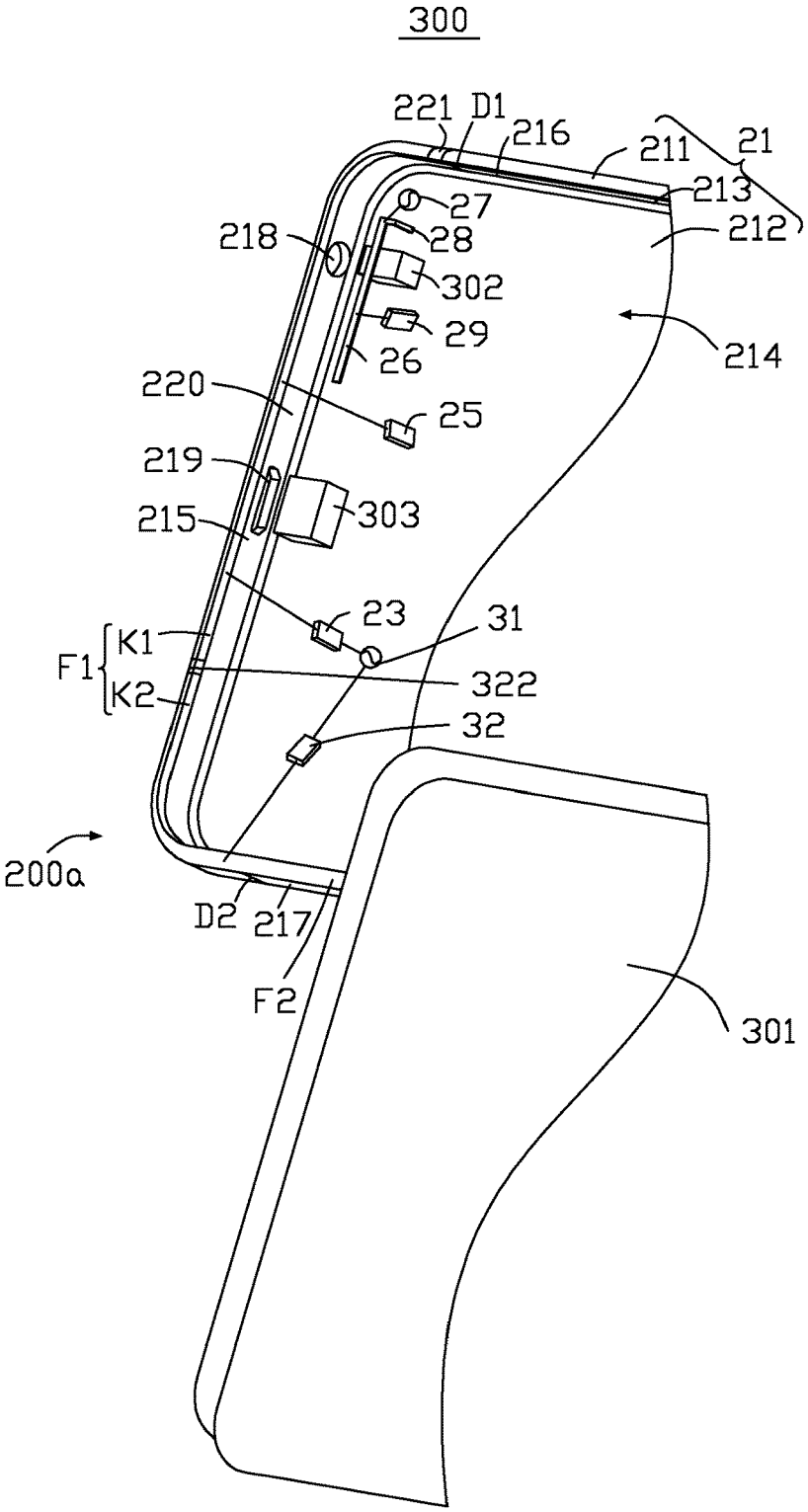
FIG. 33 is an isometric view of a third exemplary embodiment of a wireless communication device using a third exemplary antenna structure.

FIG. 33 illustrates a third exemplary antenna structure 200*a*. The antenna structure 200*a* includes a housing 21, a first feed source 31, a matching circuit 23, a first switching circuit 25, a radiator 26, a second feed source 27, a second ground portion 28, and a second switching circuit 29. The housing 21 includes a front frame 211, a backboard 212, and a side frame 213. The side frame 213 includes an end portion 215, a first side portion 216, and a second side portion 217. The side frame 213 defines a slot 220. The front frame 211 defines a first gap 221 and a second gap 222.

In this exemplary embodiment, the antenna structure 200*a* differs from the antenna structure 200 in that the antenna structure 200*a* does not includes the first ground portion 24 of the antenna structure 200 and the antenna structure 200*a* includes only one ground portion, that is, the second ground portion 28.

In this exemplary embodiment, a location of the second gap 322 of the antenna structure 200*a* is different from a location of the second gap 222 of the antenna structure 200. In this exemplary embodiment, the first gap 221 is defined on the front frame 211 and communicates with the first end D1 of the slot 220 positioned on the first side portion 216. The second gap 322 is defined on the front frame 211. The second gap 222 is not defined at a location of the front frame 211 corresponding to the second end D2 of the slot 220. The second gap 322 is defined between the first end D1 and the second end D2. The second gap 322 is also positioned adjacent to the second side portion 217.

The housing 21 is divided into two portions by the slot 220 and the first gap 221. The two portions includes a first portion F1 and a second portion F2. One portion of the front frame 211 extending from one side of the first gap 221 to the second end D2 of the slot 220 forms the first portion F1. The other portions of the housing 21 forms the second portion F2. The second portion F2 is grounded.

The first portion F1 is further divided into a first branch K1 and a second branch K2 by the second gap 322. A portion of the front frame 211 between the first gap 221 and the second gap 322 forms the first branch K1. Another portion of the front frame 211 extending from a side of the second gap 322 to the second end D2 of the slot 220 forms the second branch K2. The first branch K1 is longer than the second branch K2.

In this exemplary embodiment, the connecting relationship among the first feed source 31 with other elements is different from that of the first feed source 22 of the antenna structure 200. In this exemplary embodiment, one end of the first feed source 31 is electrically connected to the first branch K1 where it is adjacent to the second gap 322, through the matching circuit 23. Another end of the first feed source 31 is electrically connected to the second branch K2 where it is adjacent to the second end D2 through another matching circuit 32. Current can thus be fed respectively to the first branch K1 and the second branch K2.

Figure 34:
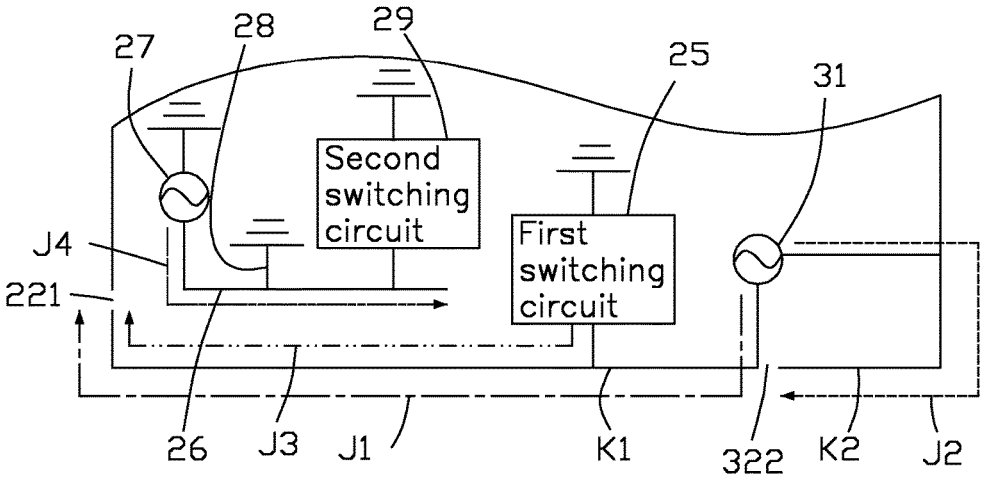
FIG. 34 is a current path distribution graph of the antenna structure of FIG. 33.

Per FIG. 34, when the first feed source 31 supplies current, the current flows through the first branch K1 of the first portion F1 and flows towards the first gap 221 (e.g., path J1) to activate a first operation mode, to generate radiation signals in a first frequency band. In this exemplary embodiment, the first operation mode is a low frequency operation mode. The first frequency band is a frequency band of about 704-960 MHz.

When the first feed source 31 supplies current, the current flows through the second branch K2 and flows towards the second gap 322 (e.g., path J2). Then the second branch K2 activates a second operation mode for generating radiation signals in a second frequency band. In this exemplary embodiment, the second operation mode is a middle frequency operation mode. A frequency of the second frequency band is higher than a frequency of the first frequency band. The second frequency band is a frequency band of about 1710-1990 MHz.

In addition, the current from the first branch K1 flows to the resonance circuit 255 of the first switching circuit 25 and flows towards the first gap 221 (e.g., path J3). Then the first branch K1 together with the resonance circuit 255 activates a third operation mode for generating radiation signals in a third frequency band. The third frequency band is a frequency band of about 2110-2170 MHz. When the second feed source 27 supplies current, the current flows through the radiator 26 (e.g., path J4) and the radiator 26 activates a fourth operation mode for generating radiation signals in a fourth frequency band. The fourth frequency band is a frequency band of about 2300-2690 MHz.

In this exemplary embodiment, when the antenna structure 200*a* works at the LTE-A low, middle, and high frequency operation modes, a scattering parameter graph and a total radiating efficiency graph of the antenna structure 200*a* are consistent with the scattering parameter graph and a total radiating efficiency graph of the antenna structure 200 shown in FIG. 31 and FIG. 32.

Figure 35:
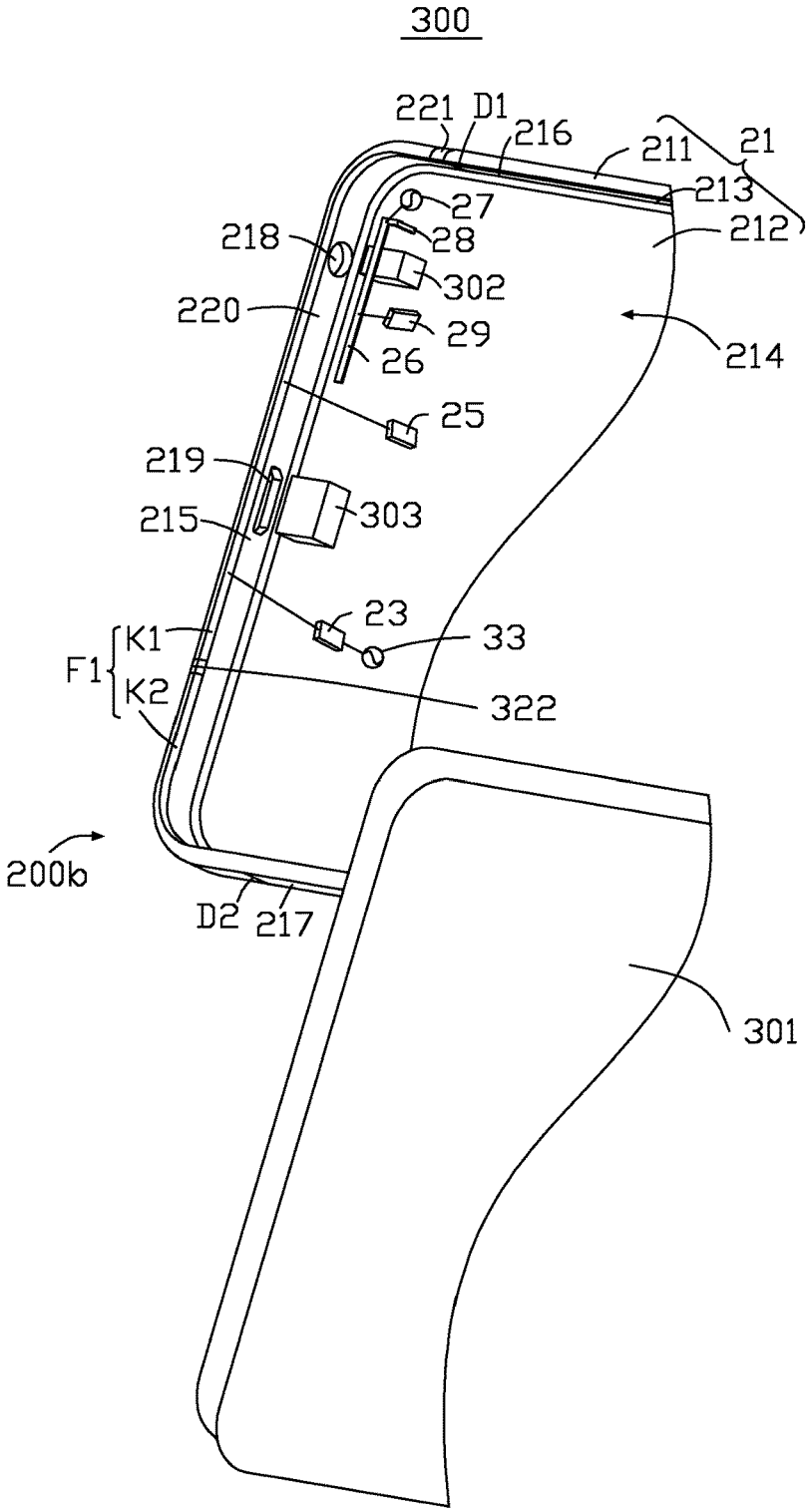
FIG. 35 is an isometric view of a fourth exemplary embodiment of a wireless communication device using a fourth exemplary antenna structure.
Figure 36:
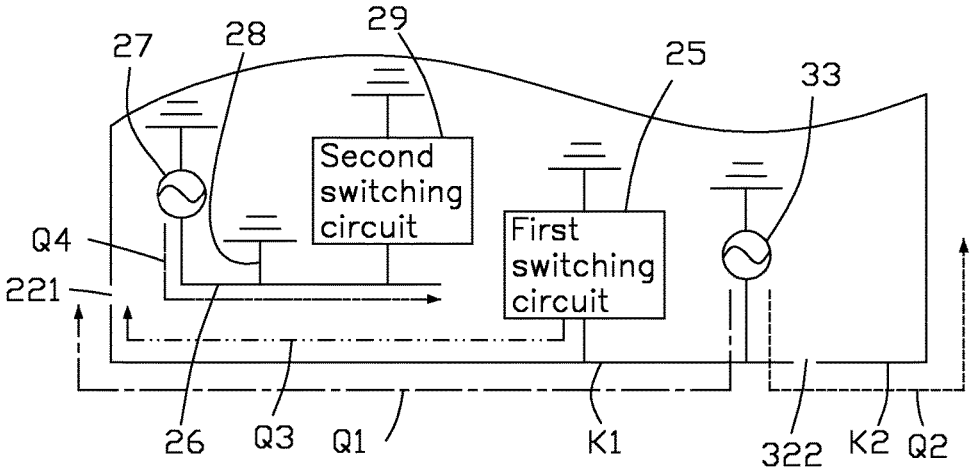
FIG. 36 is a current path distribution graph of the antenna structure of FIG. 35.

FIG. 35 illustrates a fourth exemplary antenna structure 200*b*. The antenna structure 200*b* includes a housing 21, a first feed source 33, a matching circuit 23, a first switching circuit 25, a radiator 26, a second feed source 27, a second ground portion 28, and a second switching circuit 29. The housing 21 includes a front frame 211, a backboard 212, and a side frame 213. The side frame 213 includes an end portion 215, a first side portion 216, and a second side portion 217. The side frame 213 defines a slot 220. The front frame 211 defines a first gap 221 and a second gap 222.

In this exemplary embodiment, the antenna structure 200*b* differs from the antenna structure 200*a* in that the connecting relationship among the first feed source 33 with other elements is different to that of the first feed source 31 of the antenna structure 200*a*. In this exemplary embodiment, one end of the first feed source 33 is electrically connected to the first branch K1 where it is adjacent to the second gap 322 through the matching circuit 23. Another end of the first feed source 33 is electrically connected to the backboard 212 to be grounded.

Per FIG. 35, when the first feed source 33 supplies current, the current flows through the first branch K1 of the first portion F1 and flows towards the first gap 221 (e.g., path Q1) to activate a first operation mode, to generate radiation signals in a first frequency band. When the first feed source 31 supplies current, the current flows through the first branch K1, is coupled to the second branch K2 through the second gap 322, and flows to the backboard 212 (e.g., path Q2). Then the second branch K2 activates a second operation mode for generating radiation signals in a second frequency band.

In addition, the current from the first branch K1 flows to the resonance circuit 255 of the first switching circuit 25 and flows towards the first gap 221 (e.g., path Q3). Then the first branch K1 further activates a third operation mode for generating radiation signals in a third frequency band. When the second feed source 27 supplies current, the current flows through the radiator 26 (e.g., path Q4) and the radiator 26 activates a fourth operation mode for generating radiation signals in a fourth frequency band.

In this exemplary embodiment, the paths Q1-Q4 correspond to the first to fourth operation modes and to first to fourth frequency bands respectively and are consistent with the paths J1-J4 of FIG. 34. When the antenna structure 200*b* works at the LTE-A low, middle, and high frequency operation modes, a scattering parameter graph and a total radiating efficiency graph of the antenna structure 200*b* are consistent with the scattering parameter graph and a total radiating efficiency graph of the antenna structure 200 shown in FIG. 31 and FIG. 32.

The antenna structure 100 of first exemplary embodiment, the antenna structure 200 of second exemplary embodiment, the antenna structure 200*a* of third exemplary embodiment, and the antenna structure 200*b* of fourth exemplary embodiment can be applied to one wireless communication device. For example, the antenna structure 100 can be positioned at an upper end of the wireless communication device to serve as an auxiliary antenna. The antenna structures 200, 200*a*, or 200*b* can be positioned at a lower end of the wireless communication device to serve as a main antenna. When the wireless communication device sends wireless signals, the wireless communication device can use the main antenna to send wireless signals. When the wireless communication device receives wireless signals, the wireless communication device can use the main antenna and the auxiliary antenna to receive wireless signals.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a metal housing, the metal housing comprising a front frame, a backboard, and a side frame, the side frame being positioned between the front frame and the backboard; wherein the side frame defines a slot, the front frame defines a first gap and a second gap, the first gap communicates with a first end of the slot and extends to cut across the front frame, the second gap is positioned between the first gap and a second end of the slot and extends to cut across the front frame; the metal housing is divided into at least a first branch and a second branch by the slot, the first gap, and the second gap; the portion of the front frame between the first gap and the second gap forms the first branch; the portion of the front frame between the second gap and the second end forms the second branch; the second branch is grounded at the second end;

a first feed source, the first feed source electrically connected to the first branch; and a first switching circuit, one end of the first switching circuit electrically connected to the first branch and another end of the first switching circuit being grounded.

2. The antenna structure of claim 1, wherein the slot, the first gap, and the second gap are all filled with insulating material.

3. The antenna structure of claim 1, wherein one end of the first feed source is electrically connected to the first branch and another end of the first feed source is electrically connected to the second branch; when the first feed source supplies current, the current flows through the first branch and flows towards the first gap to activate a first operation mode to generate radiation signals in a first frequency band; when the first feed source supplies current, the current flows through the second branch and flows towards the second gap to activate a second operation mode to generate radiation signals in a second frequency band; and a frequency of the second frequency band is higher than a frequency of the first frequency band.

4. The antenna structure of claim 3, wherein the first switching circuit comprises a switching unit and a plurality of switching elements, the switching unit is electrically connected to the first branch, the switching elements are connected in parallel to each other, one end of each switching element is electrically connected to the switching unit, and the other end of each switching element is electrically connected to the backboard; through controlling the switching unit to switch, the switching unit is switched to different switching elements and the first frequency band is adjusted.

5. The antenna structure of claim 4, wherein the first switching circuit further comprises a resonance circuit, the resonance circuit is configured to drive the first branch to activate a third operation mode to generate radiation signals in a third frequency band; and a frequency of the third frequency band is higher than a frequency of the second frequency band.

6. The antenna structure of claim 5, wherein the first switching circuit comprises only one resonance circuit, the resonance circuit is electrically connected between the first branch and the backboard, and the resonance circuit is connected in parallel to the switching unit and at least one switching element.

7. The antenna structure of claim 5, wherein the first switching circuit comprises a plurality of resonance circuits, a number of the resonance circuits is equal to a number of the switching elements, each resonance circuit is electrically connected in parallel to one of the switching elements between the switching unit and the backboard, when the first frequency band is adjusted, the plurality of resonance circuits keeps the third frequency band unchanged.

8. The antenna structure of claim 5, wherein the first switching circuit comprises a plurality of resonance circuits, a number of the resonance circuits is equal to a number of the switching elements, each resonance circuit is electrically connected in parallel to one of the switching elements between the switching unit and the backboard, when the first frequency band is adjusted, the plurality of resonance circuits correspondingly adjusts the third frequency band.

9. The antenna structure of claim 5, further comprising a radiator, a second feed source, and a ground portion, wherein the side frame comprises an end portion, a first side portion, and a second side portion, the first side portion and the second side portion are respectively connected to two ends of the end portion; the radiator is positioned parallel to the end portion adjacent to the first side portion; the second feed source and the ground portion are both electrically connected to the radiator; when the second feed source supplies current, the current flows through the radiator to activate a fourth operation mode to generate radiation signals in a fourth frequency band; and a frequency of the fourth frequency band is higher than a frequency of the third frequency band.

10. The antenna structure of claim 9, further comprising a second switching circuit, wherein one end of the second switching circuit is electrically connected to the radiator, another end of the second switching circuit is grounded to adjust the fourth frequency band.

11. The antenna structure of claim 9, wherein a wireless communication device uses at least two of the first branch, the second branch, and the radiator to receive or send wireless signals at multiple frequency bands simultaneously through carrier aggregation (CA) technology of Long Term Evolution Advanced (LTE-A).

12. The antenna structure of claim 1, wherein one end of the first feed source is electrically connected to the first branch and another end of the first feed source is grounded; when the first feed source supplies current, the current flows through the first branch and flows towards the first gap to activate a first operation mode to generate radiation signals in a first frequency band; when the first feed source supplies current, the current is coupled to the second branch through the second gap and flows towards the backboard to activate a second operation mode to generate radiation signals in a second frequency band; and a frequency of the second frequency band is higher than a frequency of the first frequency band.

13. The antenna structure of claim 1, wherein the backboard is an integral and single metallic sheet, the backboard is directly connected to the side frame and there is no gap formed between the backboard and the side frame, the backboard does not define any slot, break line, and/or gap for separating the backboard.

14. A wireless communication device comprising:

an antenna structure, the antenna structure comprising:

a metal housing, the metal housing comprising a front frame, a backboard, and a side frame, the side frame being positioned between the front frame and the backboard; wherein the side frame defines a slot, the front frame defines a first gap and a second gap, the first gap communicates with a first end of the slot and extends to cut across the front frame, the second gap is positioned between the first gap and a second end of the slot and extends to cut across the front frame; the metal housing is divided into at least a first branch and a second branch by the slot, the first gap, and the second gap; the portion of the front frame between the first gap and the second gap forms the first branch; the portion of the front frame between the second gap and the second end forms the second branch; the second branch is grounded at the second end;

a first feed source, the first feed source electrically connected to the first branch; and a first switching circuit, one end of the first switching circuit electrically connected to the first branch and another end of the first switching circuit being grounded.

15. The wireless communication device of claim 14, further comprising a display, wherein the front frame defines an opening, the display is received in the opening, a display surface of the display is exposed at the opening and is positioned parallel to the backboard.

16. The wireless communication device of claim 14, wherein the slot, the first gap, and the second gap are all filled with insulating material.

17. The wireless communication device of claim 14, wherein one end of the first feed source is electrically connected to the first branch and another end of the first feed source is electrically connected to the second branch; when the first feed source supplies current, the current flows through the first branch and flows towards the first gap to activate a first operation mode to generate radiation signals in a first frequency band; when the first feed source supplies current, the current flows through the second branch and flows towards the second gap to activate a second operation mode to generate radiation signals in a second frequency band; and a frequency of the second frequency band is higher than a frequency of the first frequency band.

18. The wireless communication device of claim 17, wherein the first switching circuit comprises a switching unit and a plurality of switching elements, the switching unit is electrically connected to the first branch, the switching elements are connected in parallel to each other, one end of each switching element is electrically connected to the switching unit, and the other end of each switching element is electrically connected to the backboard; through controlling the switching unit to switch, the switching unit is switched to different switching elements and the first frequency band is adjusted.

19. The wireless communication device of claim 18, wherein the first switching circuit further comprises a resonance circuit, the resonance circuit is configured to drive the first branch to activate a third operation mode to generate radiation signals in a third frequency band; and a frequency of the third frequency band is higher than a frequency of the second frequency band.

20. The wireless communication device of claim 19, wherein the first switching circuit comprises only one resonance circuit, the resonance circuit is electrically connected between the first branch and the backboard, and the resonance circuit is connected in parallel to the switching unit and at least one switching element.

21. The wireless communication device of claim 19, wherein the first switching circuit comprises a plurality of resonance circuits, a number of the resonance circuits is equal to a number of the switching elements, each resonance circuit is electrically connected in parallel to one of the switching elements between the switching unit and the backboard, when the first frequency band is adjusted, the plurality of resonance circuits keeps the third frequency band unchanged.

22. The wireless communication device of claim 19, wherein the first switching circuit comprises a plurality of resonance circuits, a number of the resonance circuits is equal to a number of the switching elements, each resonance circuit is electrically connected in parallel to one of the switching elements between the switching unit and the backboard, when the first frequency band is adjusted, the plurality of resonance circuits correspondingly adjusts the third frequency band.

23. The wireless communication device of claim 14, wherein one end of the first feed source is electrically connected to the first branch and another end of the first feed source is grounded; when the first feed source supplies current, the current flows through the first branch and flows towards the first gap to activate a first operation mode to generate radiation signals in a first frequency band; when the first feed source supplies current, the current is coupled to the second branch through the second gap and flows towards the backboard to activate a second operation mode to generate radiation signals in a second frequency band; and a frequency of the second frequency band is higher than a frequency of the first frequency band.

24. The wireless communication device of claim 14, further comprising an earphone interface module, the antenna structure further comprises a radiator, a second feed source, a ground portion, and a second switching circuit, the side frame comprises an end portion, a first side portion, and a second side portion, the first side portion and the second side portion are respectively connected to two ends of the end portion; the radiator is positioned parallel to the end portion, passes over the earphone interface module, and is spaced apart from the earphone interface module; the second feed source is positioned between the first side portion and the earphone interface module; the second feed source is electrically connected to the radiator; the ground portion is positioned at the side of the earphone interface module adjacent to the first side portion and is electrically connected to the radiator; the second switching circuit is positioned at the side of the earphone interface module adjacent to the second side portion; one end of the second switching circuit is electrically connected to the radiator, and another end of the second switching circuit is electrically connected to the backboard to adjust a frequency of the antenna structure.

25. The wireless communication device of claim 24, wherein the wireless communication device uses at least two of the first branch, the second branch, and the radiator to receive or send wireless signals at multiple frequency bands simultaneously through carrier aggregation (CA) technology of Long Term Evolution Advanced (LTE-A).

26. The wireless communication device of claim 14, wherein the backboard is an integral and single metallic sheet, the backboard is directly connected to the side frame and there is no gap formed between the backboard and the side frame, the backboard does not define any slot, break line, and/or gap for separating the backboard.

* * * * *